US005111675A

United States Patent [19]

Murata

[11] Patent Number: 5,111,675

[45] Date of Patent: May 12, 1992

[54] PENETRATION BENDING METHOD AND PENETRATION BENDING MACHINE THEREFOR

[75] Inventor: Makoto Murata, Yokohama, Japan

[73] Assignee: Nissin Seiki Kabushiki Kaisha, Tokyo, Japan

[21] Appl. No.: 523,128

[22] Filed: May 14, 1990

[30] Foreign Application Priority Data

May 15, 1989 [JP] Japan ..... 1-120894

[51] Int. Cl.[5] ..... B21D 7/12

[52] U.S. Cl. ..... 72/7; 72/166

[58] Field of Search ..... 72/166, 173-175, 72/12, 9, 7

[56] References Cited

U.S. PATENT DOCUMENTS

| | | | |
|---|---|---|---|
| 3,293,897 | 12/1966 | Holter | 72/166 |
| 4,031,733 | 6/1977 | Coody | 72/166 |
| 4,080,815 | 3/1978 | Foster | 72/173 |
| 4,796,449 | 1/1989 | Berne | 72/17 |
| 4,893,489 | 1/1990 | Mason | 72/173 |

FOREIGN PATENT DOCUMENTS

| | | | |
|---|---|---|---|
| 107921 | 4/1989 | Japan . | |
| 1400713 | 1/1988 | U.S.S.R. | 72/166 |

*Primary Examiner*—Daniel C. Crane
*Attorney, Agent, or Firm*—Thomas N. Ljungman

[57] ABSTRACT

The penetration bending method is adapted to bend a rod-like member by allowing the rod-like member to penetrate through a guide cylinder and a die in a condition where the central axis line of the guide cylinder which restrains the rod-like member so as to travel straight is offset relatively from the center of a bearing portion of the die which restrainedly bears a portion of the rod-like member penetrating through the guide cylinder. This method permits easily bending the rod-like member with high precision, without changing the shape of its cross section and with high roundness. The penetration bending machine comprises a guide cylinder, a die, a driving device for changing relative position of the guide cylinder and the die, an input device for inputting data on mechanical natures of the rod-like member and bending conditions therefor, a first memory for storing the data inputted from the input device, a second memory for storing data for displacing the guide cylinder and/or the die, and a drive control device for controlling the driving device referring to the data stored in the first and second memories.

14 Claims, 22 Drawing Sheets

PENETRATION BENDING METHOD AND PENETRATION BENDING MACHINE THEREFOR

BACKGROUND OF THE INVENTION a) Field of the Invention

The present invention relates to a penetration bending method and a bending machine for carrying out said method, more specifically to a simple penetration bending method which is applicable to plastic works for manufacturing various types of bent parts by using hollow pipes, sections and solid pipes (hereinafter referred to as rod-like members),and permit freely bending the rod-like members with high precision, as well as a bending machine for carrying out said method.

b) Description of the Prior Art

Bent parts of pipes, etc. are utilized in various fields for manufacturing pipings, transportation appliances, domestic electrical products, mechanical structures, etc., and will find more fields of application the future. In order to manufacture the bent parts of the rod-like members to be used in the fields mentioned above, it is conventional to adopt the basic bending methods such as press bending, roll bending and so on.

Under the current circumstance where the bent parts are finding wider fields of application, it is demanded to lower the cost required for the bending works, enhance bending precision and obtain rod-like member which are bent continuously and complicatedly for logically building the rod-like members into narrow spaces reserved in various types of structures.

In order to satisfy these demands, the inventor proposed, as a method for bending pipes or sections with high precision, the bending method which was characterized by performing drawing or extrusion molding of pipes or sections in a condition where the bearing portion of a die restrainedly bearing a portion of a rod-like member is inclined relative to the feeding direction of pipe or section (Japanese Preliminary Patent Publication No. Sho 62-264137).

However, the conventional bending methods hardly permit, due to the mechanical engineering factors inherent therein, to enhance bending precision to the levels of specifications required for bent parts and are applicable only to simple bending works. Further, it is pointed out that the conventional bending methods have a common disadvantage or inconvenience to require relatively large bending mechines even for simple bending works. In addition, the method proposed by Japanese Preliminary Patent Publication No. Sho 62-264137 permits adequately enhancing bending precision, but requires performing delicate rotational control of a die and produces a certain difficulty in composing a bending machine for carrying out the method.

SUMMARY OF THE INVENTION

In view of the circumstances described above, it is a primary object of the present invention to provide a penetration bending method which is capable of enhancing bending precision of rod-like members with simple control and a bending machine utilizing said method.

It is another object of the present invention to provide a bending method capable of limiting variation of cross section of rod-like members to be caused by bending and preventing reduction of wall thickness outside a bent pipe when the rod-like member is a pipe, and a bending machine for carrying out the method.

It is a third object of the present invention to provide a bending method capable of making bent parts free from residual stress and providing bent parts having excellent roundness, and a bending machine for carrying out the method.

It is a fourth object of the present invention to provide a bending method permitting obtaining bending angles larger than 300° and a compact bending machine for carrying out said method.

It is a fifth object of the present invention to provide a penetration bending method which permits smooth bending works with weaker compressive force and providing bent parts of complicated forms having optional bending radii, and a bending machine utilizing said method.

The penetration bending method according to the present invention uses a guide member which allows a hollow or solid rod-like member to pass straightly therethrough while restraining said member so as to travel straight and a die member which has a bearing portion for restraindly bearing a portion of the rod-like member having passed through the guide member, so that the rod-like member penetrates into the guide member and the die member in a state where the center of the die member is offset relatively from the central axis line of the guide member, whereby the rod-like member is bent. The distance as measured from the guide member to the die member is adjustable and the die member can be inclined 10° to 20° relative to the central axis line of the guide member.

The penetration bending machine according to the present invention comprises a guide member which allows a hollow or solid rod-like member to pass straightly therethrough while restraining said member so as to travel straight, a die member which has a bearing portion for restrainedly bearing a portion of the rod-like member having passed through the guide member, a driving means which is used for displacing the die member and/or the guide member for changing relative positional relationship between the die member and the guide member, an input means for inputting data on mechanical natures of rod-like members and bending conditions, a first memory means for storing the data inputted from the input means, a second memory means which stores displacement amount data for the die member and/or the guide member for setting relative positional relationship between the die member and the guide member required for carrying out the bending work corresponding to and specified by the data on the mechanical natures of the rod-like members and bending conditions, and a drive control means which controls the driving means on the basis of the data stored in the first memory means and with reference to the displacement amount data stored in the second memory means.

According to the present invention, it is possible to carry out continuously varying works by inpitting data specifying modification with time of bending conditions from the input means and allowing the first memory means to store data so that the drive control means can control the relative positions of the die member and the guide member with lapse of time on the basis of the data stored in the first memory means and referring to the data stored in the second memory means.

These and other objects as well as the features and the advantages of the present invention will become apparent from the following detailed description of the preferred embodiment when taken in conjunction with the accompanying drawings.

DETAILED DESCRIPTION OF THE PREFERRED EMBODIMENT

Figure 1:
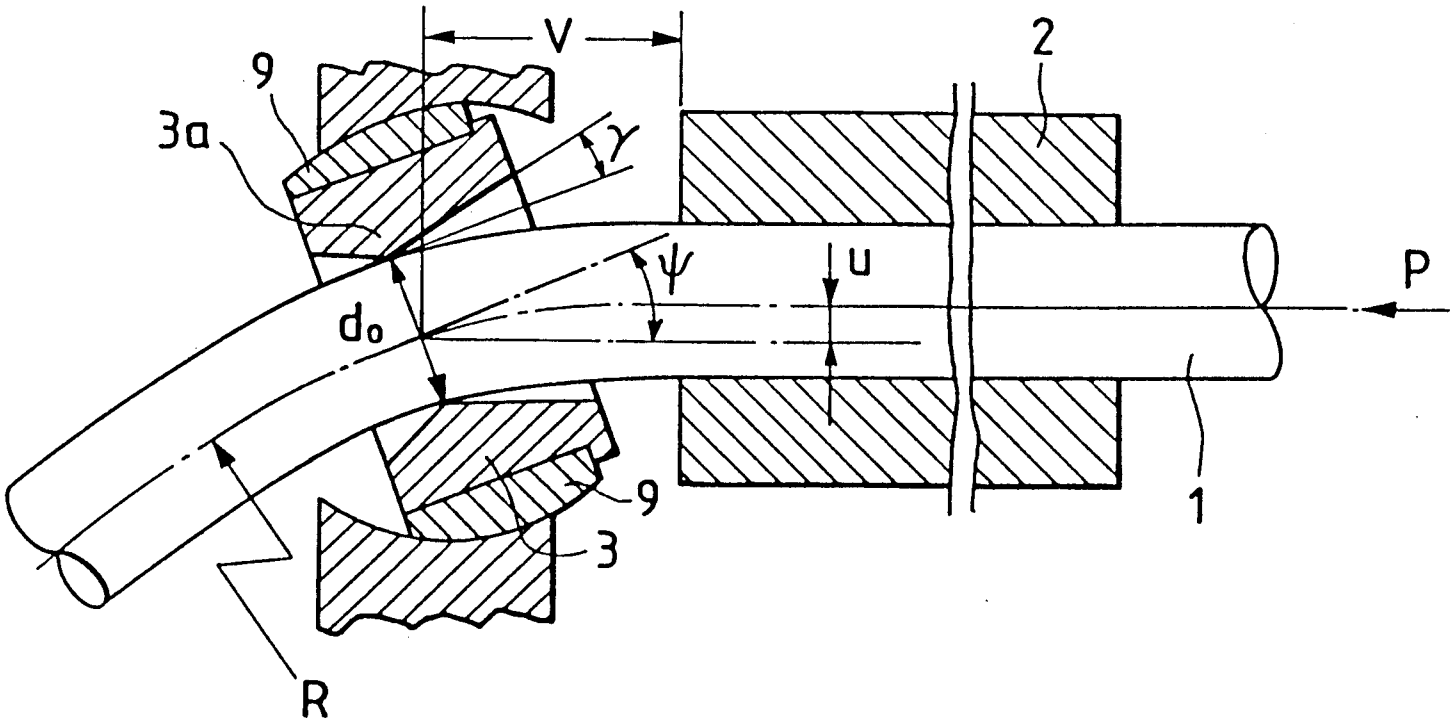
FIG. 1 is a sectional view illustrating the compositional principle of the penetration bending method.
Figure 2:
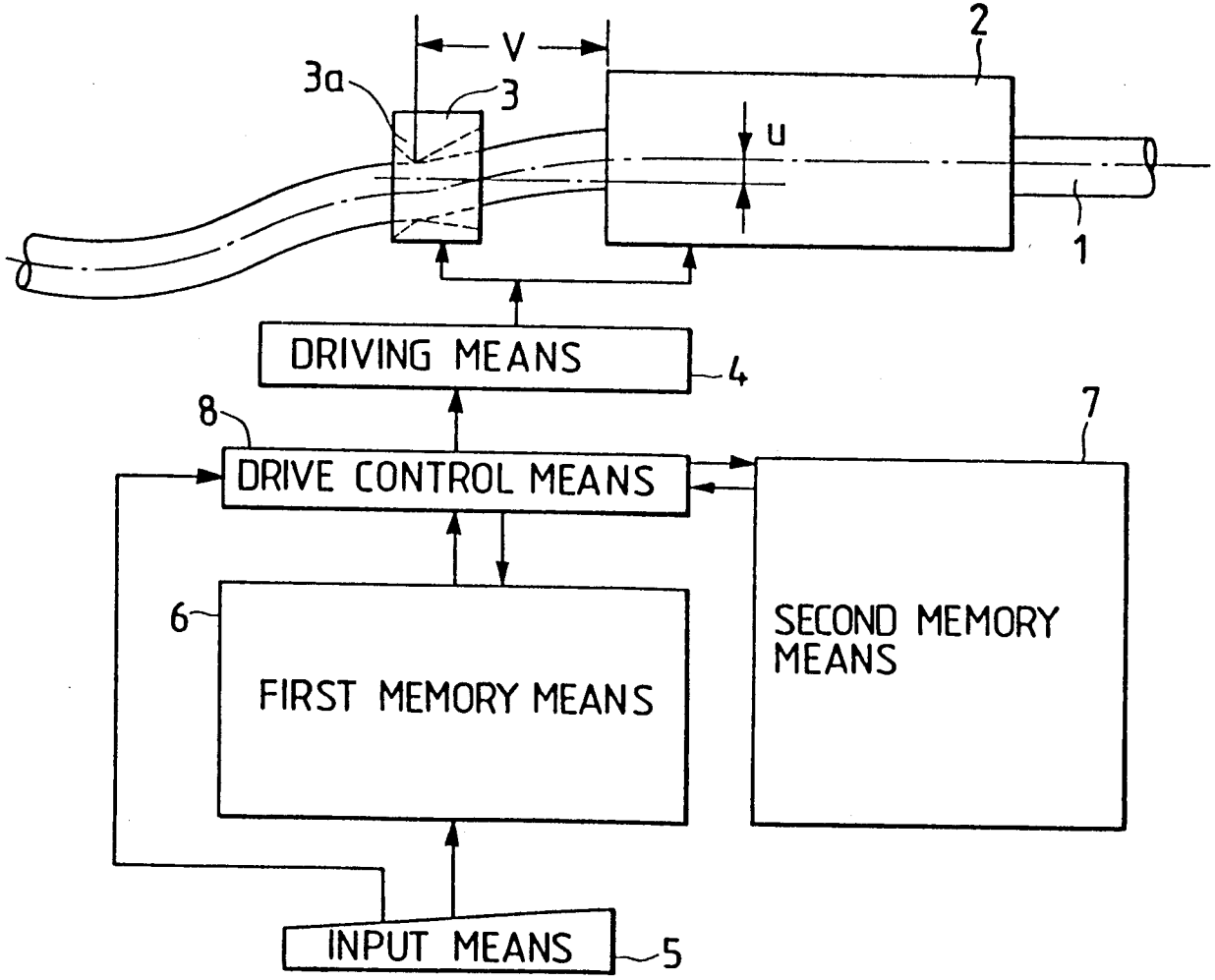
FIG. 2 shows a sectional view and a block diagram illustrating fundamental composition of the penetration bending machine.

FIG. 1 shows the compositional principle of the penetration bending method according to the present invention and FIG. 2 illustrates the fundamental composition of the penetration bending machine according to the present invention. In these drawings, the reference numeral 1 represents a rod-like member to be subjected to the bending work, the reference numeral 2 designates a guide cylinder capable of allowing the rod-like member to pass therethrough while restraining said member so as to travel straight, the reference numeral 3 denotes a die having a bearing portion 3*a* which restrainedly supports a portion of the rod-like member 1 having passed through the guide cylinder 2, the reference numeral 4 represents a driving means capable of displacing the guide cylinder 2 and/or the die 3 for changing relative positional relationship between the guide cylinder 2 and the die 3, the reference numeral 5 designates an input means for inputting data on mechanical natures of the rod-like member 1 (tensile strength, elongation of the material thereof, type of the rod-like member 1, i.e., hollow pipe, section or solid pipe, outside diameter, thickness, etc.) and bending conditions (bending radius, roundness, flatness of cross section), the reference numeral 6 denotes a first memory means for storing the data inputted from the input means 5, the reference numeral 7 represents a second memory means for storing displacement amount data for the guide cylinder and/or the die for setting relative positional relationship between the guide cylinder 2 and the die 3 which is required for carrying out the bending work corresponding to or specified by the data on the mechanical natures of the rod-like member 1 and the bending conditions, and the reference numeral 8 designates a drive control means for controlling the driving means 4 on the basis of the data stored in the first memory means 6 and referring to the displacement amount data stored in the second memory means 7. This composition is characterized in that the rod-like member 1 is allowed to penetrate into the guide cylinder 2 and the die 3 in a condition where the center of the bearing portion 3*a* of the die 3 is deviated from the central axis line of the guide cylinder 2 as shown in FIG. 1 and FIG. 2 (in a condition where an offset u is reserved). Accordingly, it is desirable that the die 3 is supported by a die holder to be described later through hemispherical bush 9 in such a relationship where the center of the hemispherical bush 9 is conincident with the center of the bearing portion 3*a* of the die 3 as illustrated in FIG. 1. In addition, the reference symbol $d_o$ represents diameter of the bearing portion 3*a* of the die 3 and the reference symbol $\gamma$ designates die angle in FIG. 1.

Now, functions of the penetration bending machine will be explained below:

When the rod-like member 1 is allowed to penetrate into the guide cylinder 2 and the die 3 in the condition where the center of the bearing portion 3*a* of the die 3 is deviated from the center axis line of the guide cylinder 2, or the offset u is reserved as shown in FIG. 1, the rod-like member 1 is passed through the bearing portion 3*a* of the die 3 while being restrained locally thereby. In the case, a bending moment always acts on the portion of the rod-like member 1 in an approach v due to the offset u reserved. That is, the rod-like member 1 is restrained by the bearing portion 3*a* of the die 3 maintaining the offset u through a restoring force toward the original central axis line of the rod-like member 1 produced in the rod-like member due to the deviation by the offset u. Accordingly, if the reaction produced in the rod-like member 1 restrained by the bearing portion 3*a* of the die 3 is represented as P, the bending moment M ($=p\times v$) will act on the rod-like member 1. Therefore, the rod-like member 1 is subjected to the bending work in the approach v while being penetrated continuously through the bearing portion 3*a* of the die 3, and is pushed out from the bearing portion 3*a* in the form of a plastically deformed arc having the curvature R, of which, the upside of the rod-like member 1 is the outer periphery as shown in FIG. 1. At the same time, the bearing portion 3*a* of the die 3 also fills the role of reforming into the original shape, the deformation of the cross-section of the rod-like member 1 which occurs in the bending work described above. At this stage, the drive control means 8 searches for and reads out actuating amount data from the second memory means 7 on the basis of the data stored in the first memory means 6, and controls the relative positional relationship between the die 3 and the guide cylinder 2 by controlling the driving means 4 on the basis of the actuating amount data which is read out. The second memory means 7 performs a role for corresponding the actuating amount data for the die 3 and/or guide cylinder 2 (the offset u and/or the approach v) to the mechanical natures of the rod-like member 1 to be subjected to bending work and the bending conditions therefor so as to establish the optimum bending conditions. Accordingly, the penetration bending machine is capable of automatically setting the optimum relative positional relationship between the die 3 and the guide cylinder 2 for carrying out the bending work desired for the rod-like member 1 simply by inputting the data on the mechanical natures of the rod-like member 1 and the desired bending conditions.

As is understood from the foregoing description, the penetration bending method according to the present invention permits varying bending angle by changing the distance (the approach v) from the end surface of the guide cylinder 2 which is located on the side of the die 3 to the center of the bearing portion 3*a* of the die 3. Further, the penetration bending method according to the present invention permits establishing said bending conditions simply by displacing the die 3 and/or the guide cylinder 2 on a plane perpendicular to the central axis line of the guide cylinder 2. Accordingly, the penetration bending method enables to enhance bending precision for the rod-like member 1 since the offset u is controllable at high precision with a simple mechanism. When inclination angle $\theta$ of the die 3 is set at $10^\circ$ to $20^\circ$, it is possible to perform the penetration bending work with a relatively weak compressive force. Furthermore, since a sufficient space can be reserved between the guide cylinder 2 and the die 3, the penetration bending method makes it possible to bend the rod like member 1 at large angles and continuously vary bending angles by controlling the offset u. Moreover, since the bending work is carried out simply by the local slide contact between the bearing portion 3*a* and the rod-like member 1, excessive residual stress is not applied to the rod-like member 1 after the bending work and, since the outside circumference of the rod-like member 1 is restrainedly supported by the bearing portion 3*a* during the bending work, the sectional shape of the rod-like member 1 is not flattened or wall thickness thereof is not varied by the bending work.

The penetration bending machine according to the present invention is capable of performing continuously varying bending work when said machine is adapted in such a manner that data on variation with time of the bending conditions are inputted from the input means 5, the first memory means 6 stores the data, and the drive control means 8 can control the relative positional relationship between the die 3 and the guide cylinder 2 with lapse of time on the basis of the data stored in the first memory means 6 and referring to the actuating amount data stored in the second memory means 7. That is to say, when the data on variations with time of the bending conditions are preliminarily inputted and stored into the first memory means 6, the drive control means actuates the die 3 and/or the guide cylinder 2 so as to automationally set the offset u and the approach v at the optimum values thereof. In other words, when the bending conditions are stored into the first memory means 6 in correspondence to penetration lengths of the rod-like member 1 and feeding times, the drive control means 8 reads out the displacement amount data from the second memory means 7 each time the rod-like member 1 penetrates for a predetermined length or a predetermined time elapses, and displaces the die 3 and/or the guide cylinder 2 so as to establish the bending conditions corresponding to the displacement data which are read out.

Now, an experimental example using the penetration bending method according to the present invention will be described below with reference to FIG. 3 through FIG. 17.

Figure 3:
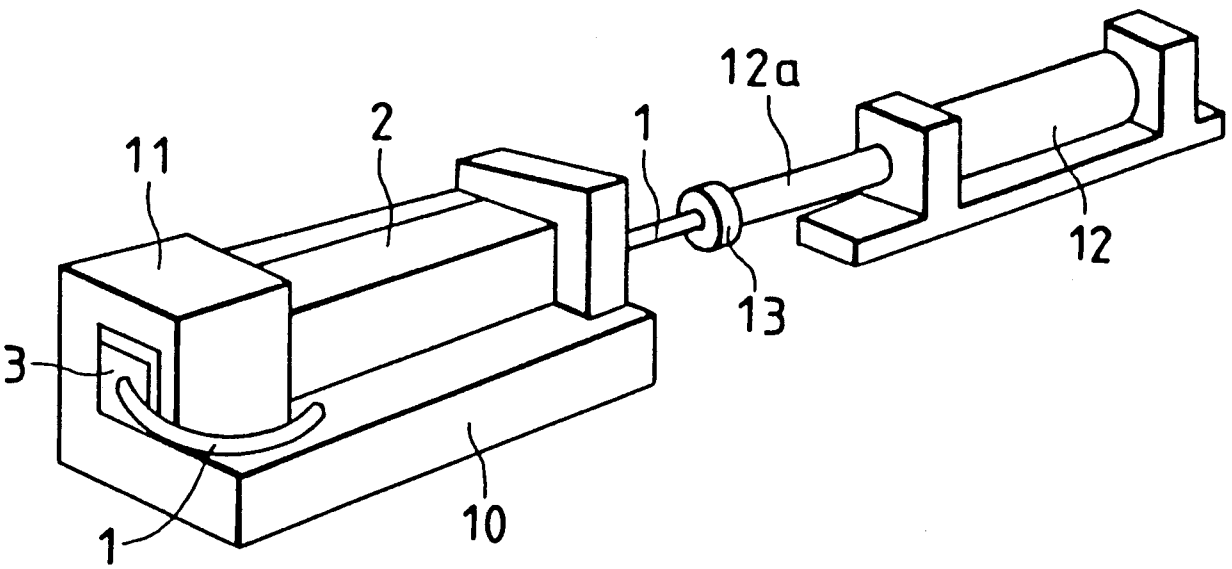
FIG. 3 is a schematic perspective view illustrating an experimental bending machine.

FIG. 3 shows a schematic perspective view of an embodiment of the bending machine prepared for the experiment. This machine consisted of a fixed stand 10 and a frame section 11 which were formed integrally. The die 3 was fixed in said frame section 11 at a predetermined position and a predetermined angle, and the guide cylinder 2 was fixed on the fixed stand 10. As a result, the relative positional relationship illustrated in FIG. 1 was established, and bending work of the rod-like member 1 was performed by allowing the rod-like member 1 to penetrate through the guide cylinder 2 and the die 3 by compressing the rear end of the rod-like member with a hydraulic cylinder 12 which was fixed as shown in FIG. 3. Further, inperposed between a rod 12*a* of the hydraulic cylinder 12 and the rod-like member 1 was a load cell 13 for measuring compressive force P of the bending work, and variations of bridge output voltage from the load cell were measured.

In this experiment, $d_0$ was set at a constant length of 20 mm. S45C was selected as a material of the die 3 and chlorinated oil corresponding to JIS class 2, No. 2 was used as the lubricating oil. On the other hand, a pipe having an outside diameter of 20.0 mm and wall thickness of 1.0 mm was selected as the rod-like member 1. The pipe was made of aluminium (A1050TD) which was not subjected to heat treatment, and has tensile strength of 144 MPa and elongation of 3%. A three-dimensional micrometer, a blade micrometer and a hemisphere-against-hemisphere-ended micrometer were used for measuring the inside diameter, the outside diameter and the wall thickness respectively of the pipe which was subjected to the bending work. In addition to the factors mentioned above, the variable to be used for evaluating experimental results were defined as follows:

L: Length of the pipe extruded by the hydrauiic cylinder 12

Roundness: $\alpha c = R_{max} - R_{min}$ (mm)

Flatness of cross section: $\alpha_f = (d_0 - d_{min})/d_0$

Variation of wall thickness: $\alpha_{ti}$ (inside bent portion) $= (t_{max} - t_0)/t_0$: $\alpha_{to}$ (outside bent portion) $= (t_0 - T_{min})/t_0$ wherein $R_{max}$: maximum value of bending radius $R_{min}$: minimum value of bending radius $d_{min}$: minimum value of outside diameter $t_{max}$: maximum value of wall thickness $t_{min}$: minimum value of wall thickness The experimental results will be described below with reference to the graphs which summarize the measured values obtained (FIG. 4 through FIG. 17).

Bending Radius

Figure 4:
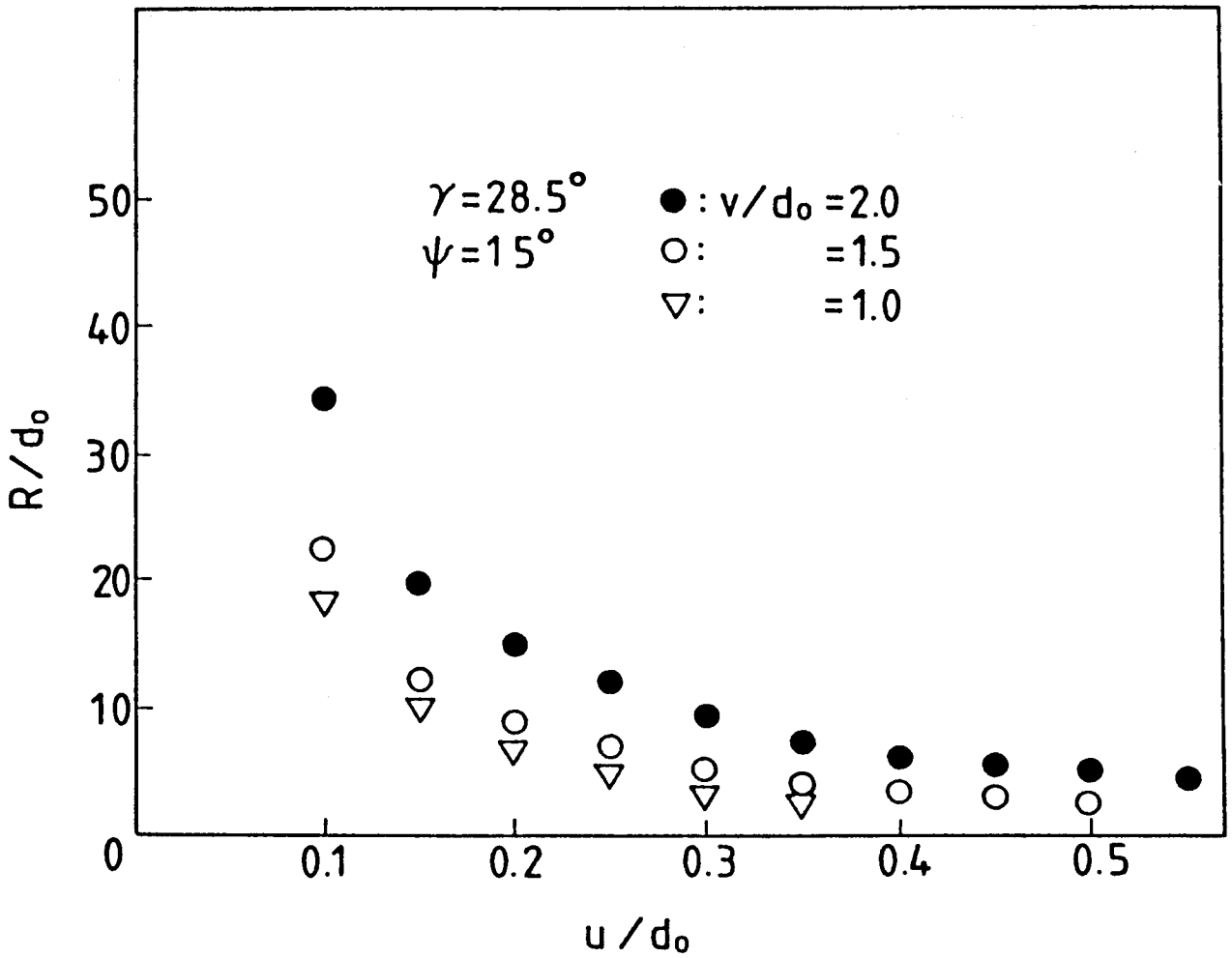
FIG. 4 is a graph illustrating the influence on bending radius due to the offset.
Figure 5:
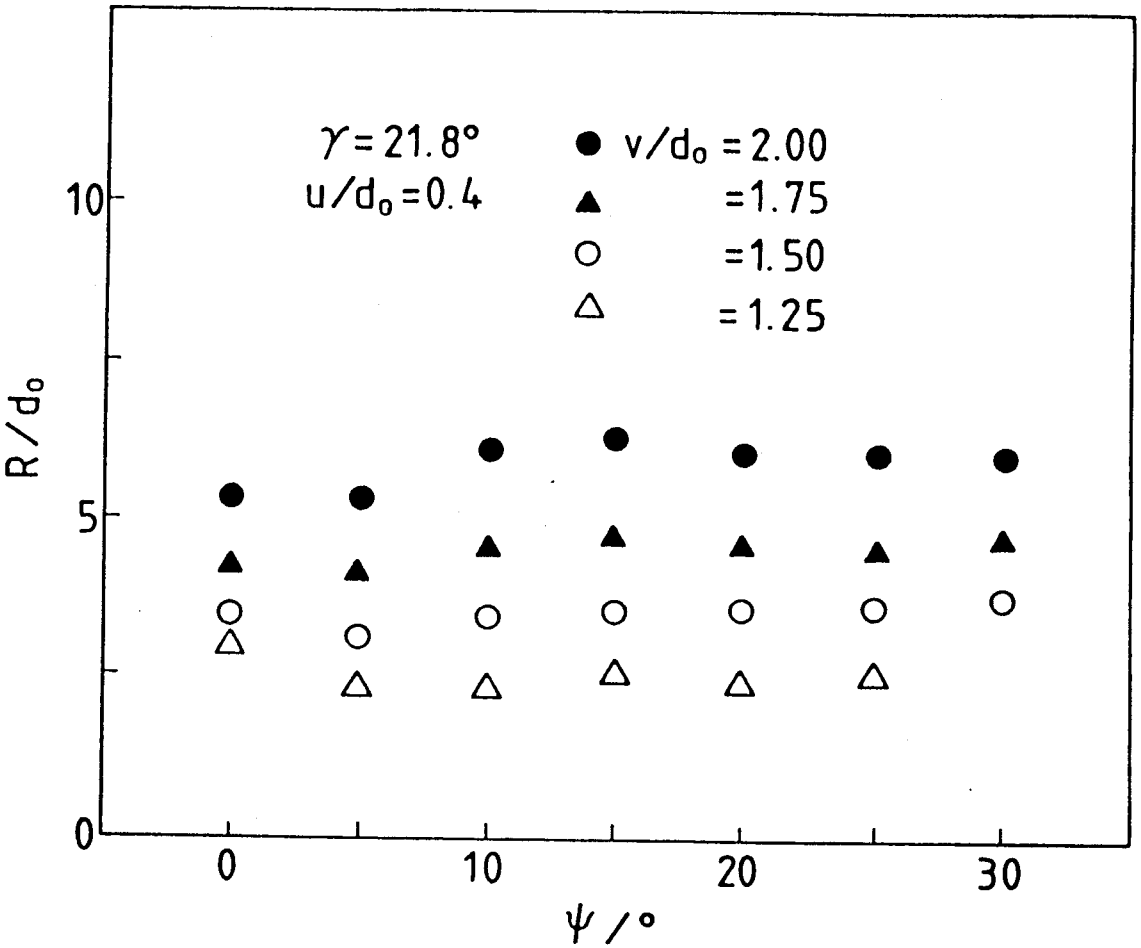
FIG. 5 is a graph illustrating the influence on bending radius due to inclination of the die.
Figure 6:
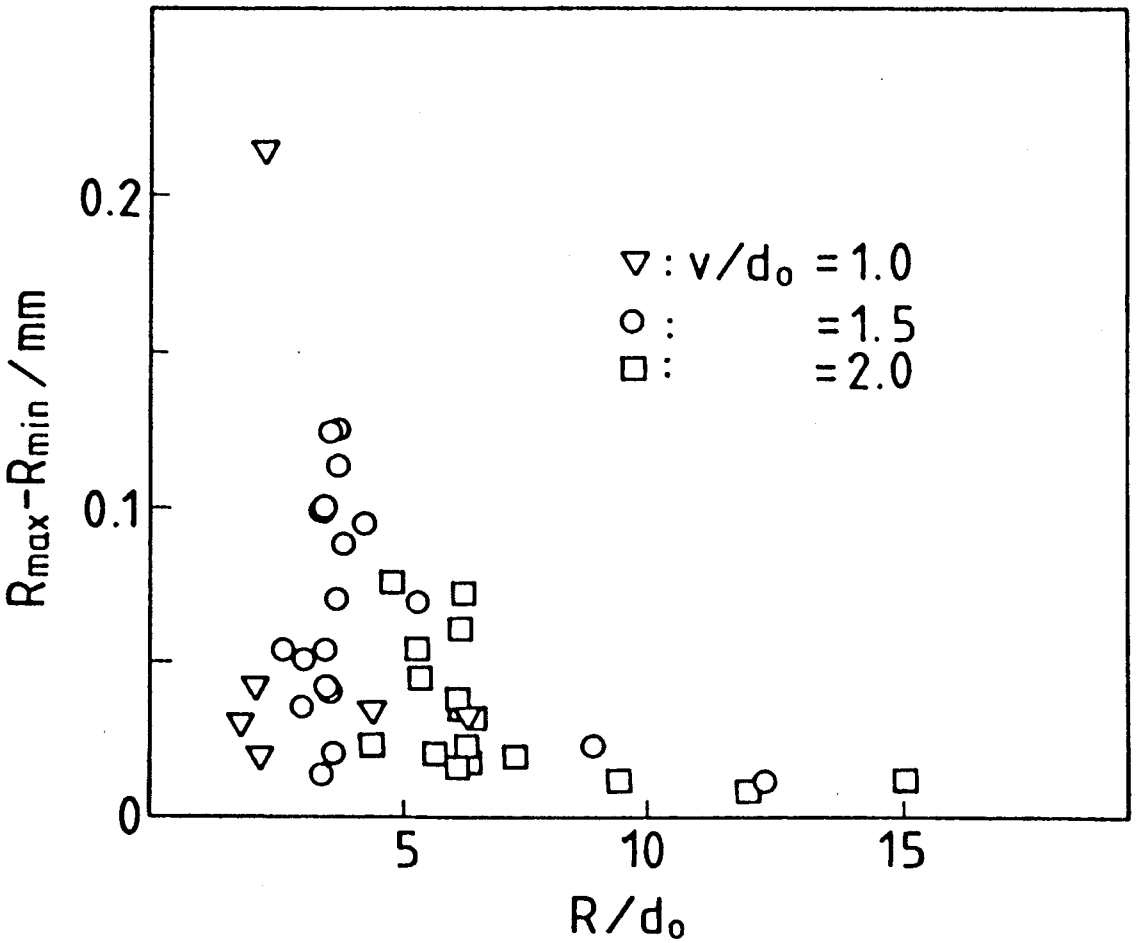
FIG. 6 is a graph illustrating the relationship between bending radius and roundness.

FIG. 4 illustrates the influence on the radius R due to the offset u by using the approach v as a parameter. As is clear from FIG. 4, the rod-like member 1 was bent more severely or compared with smaller bending radius toward the central axis line of the guide cylinder 2 as u became larger and/or v became shorter. Speaking more detailedly, the influence due to u became smaller as u became larger, and the bending angle R was reduced at lower rates for variation of u when $u/d_0$ exceeded 0.5. The bending machine could provide bending angles down to $R/d_0=1$ and perform favorable bending free from creases. Further, examinations were made on variation of the inclination angle $\psi$ of the die 3 as illustrated in FIG. 5 and clarified that the inclination angle gave little influence on the bending angle. Similarly, the die angle $\gamma$ had no tendency to influence the bending radius. FIG. 6 summarizes values of roundness $\alpha_c$ which were measured within a range of bending radius $R/d_0$ from 1.8 to 15 using the approach v as a parameter. In addition, u, v and $\psi$ which have relations to bending conditions were varied within the ranges specified in the preceding drawings. As is understood from the graph shown in FIG. 6, the bending machine was capable of performing bending works at roundness $\alpha_c$ within 0.03 mm at any bending radius when bending conditions were selected adequately though there was noticed a tendency that roundness was degraded as bending radius became smaller.

Compressive Force for Bending Work

Figure 7:
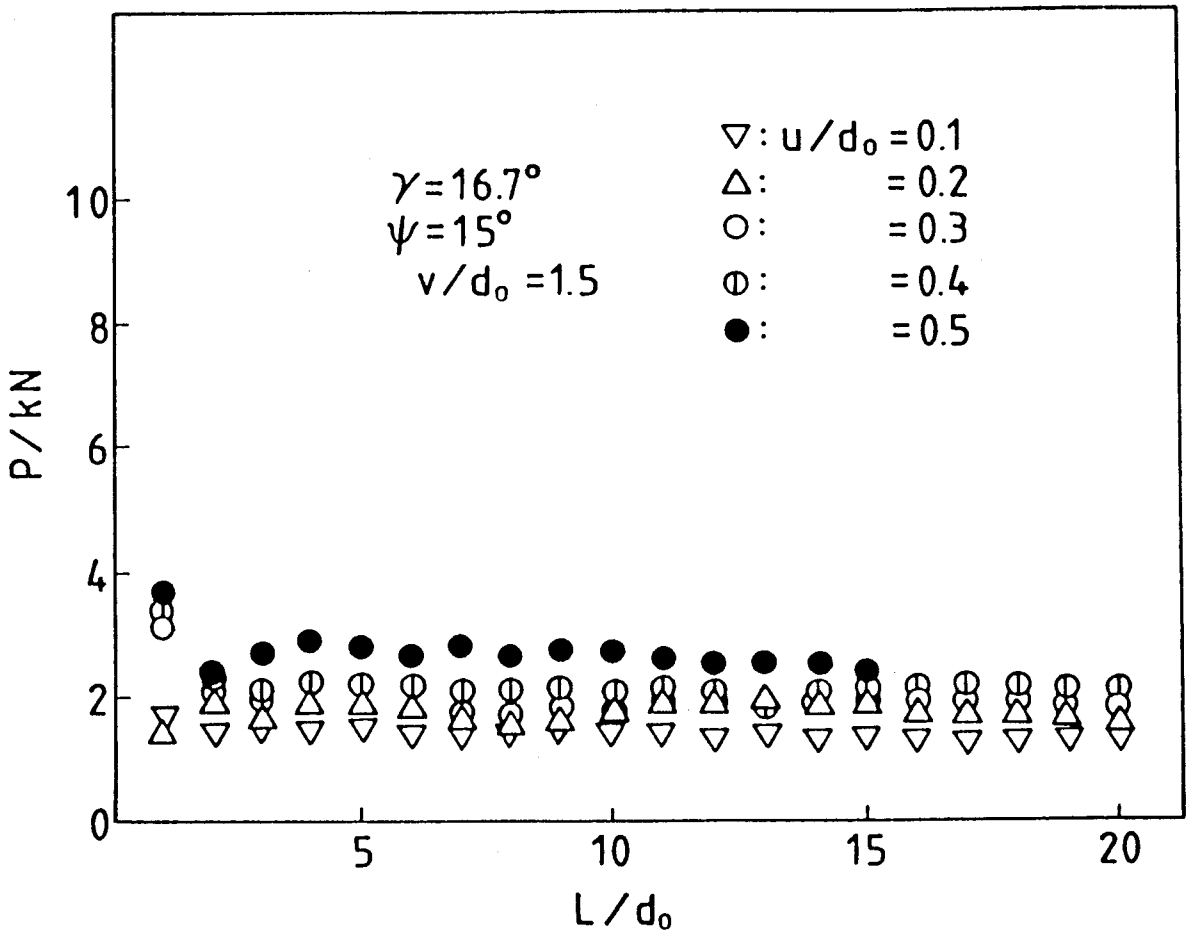
FIG. 7 is a graph illustrating the relationship between extrusion length and compressive force at various levels of the offset.
Figure 8:
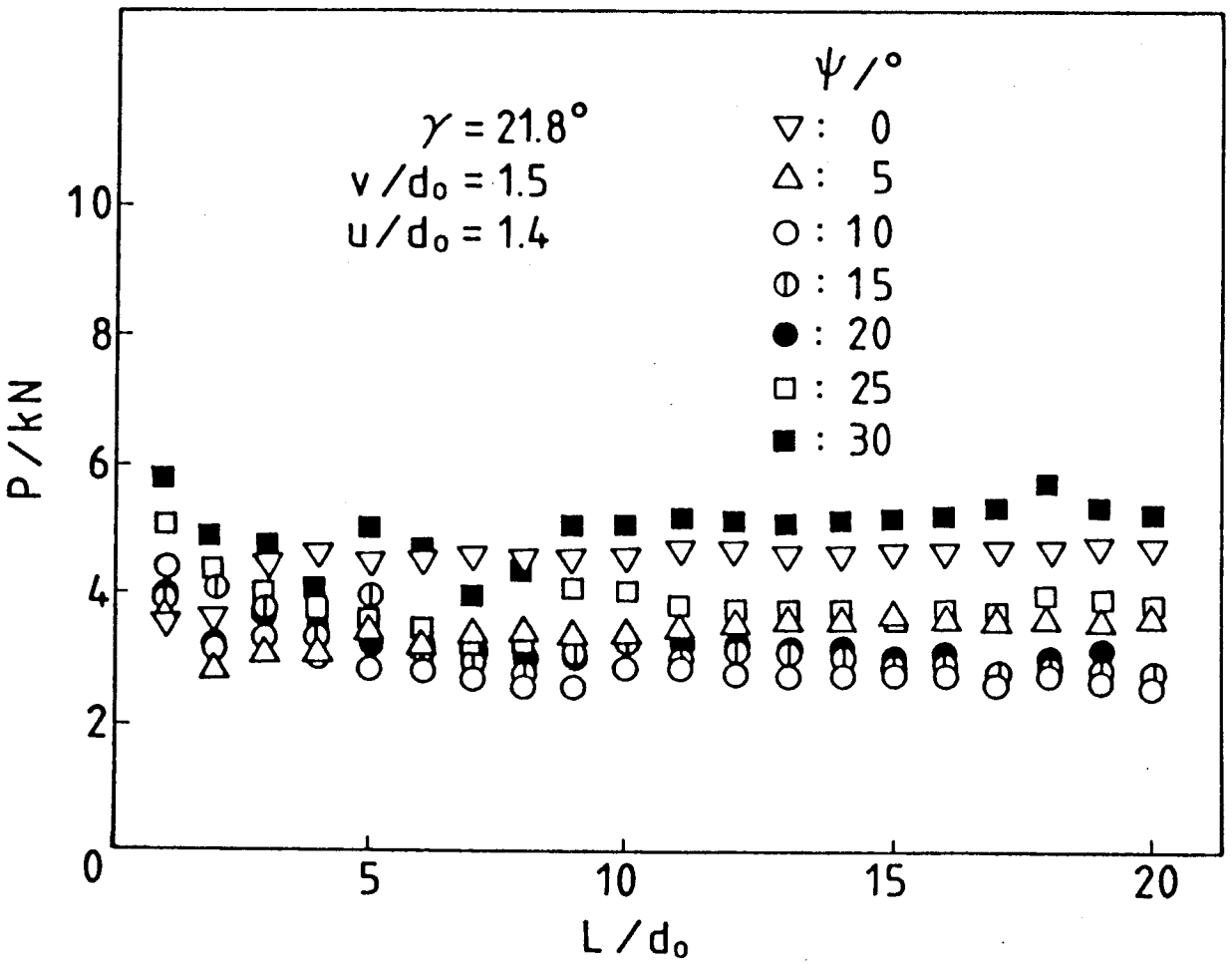
FIG. 8 is a graph illustrating the relationship between extrusion length and compressive force at various inclination angles of the die.
Figure 9:
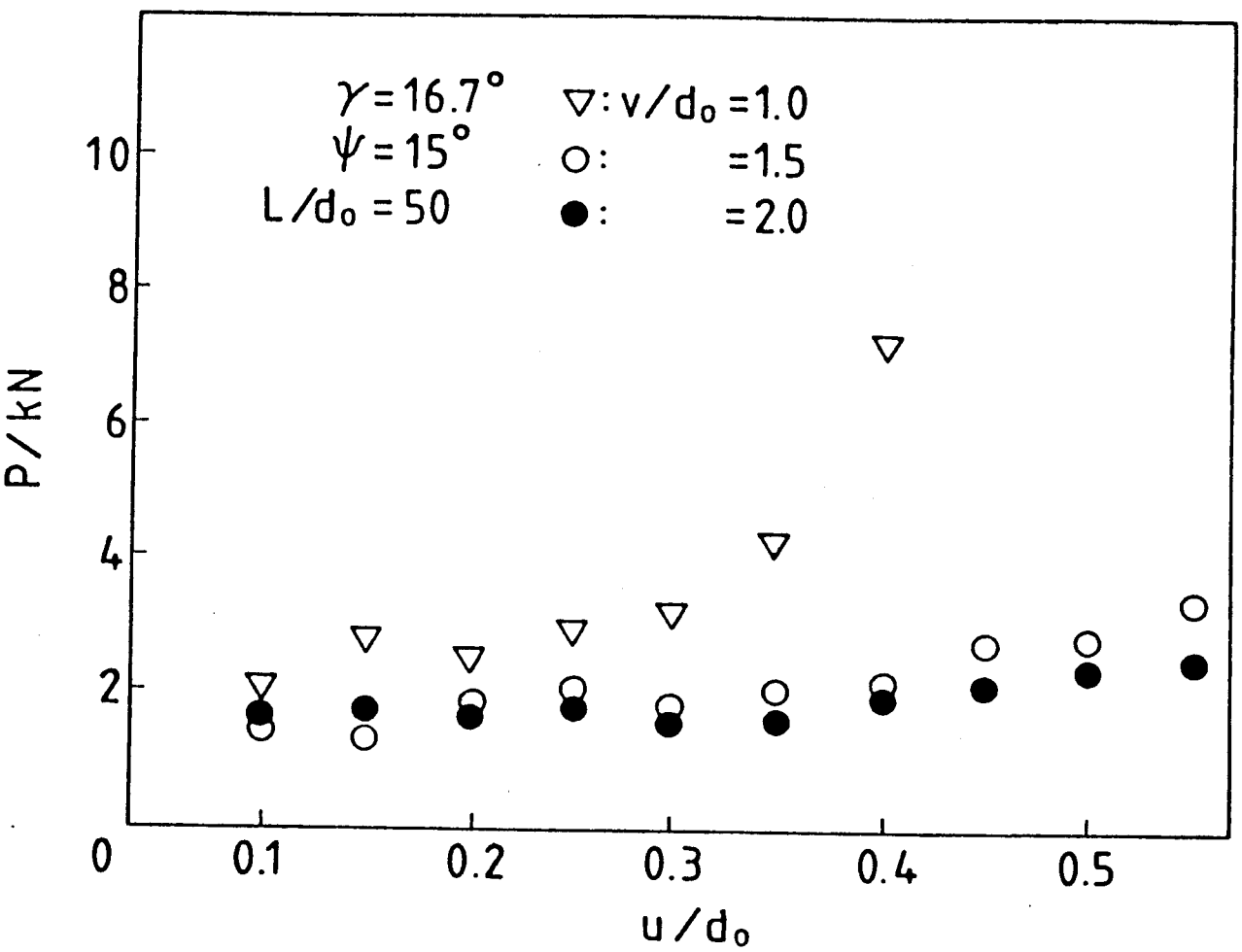
FIG. 9 is a graph illustrating the relationship between the offset and the compressive force.
Figure 10:
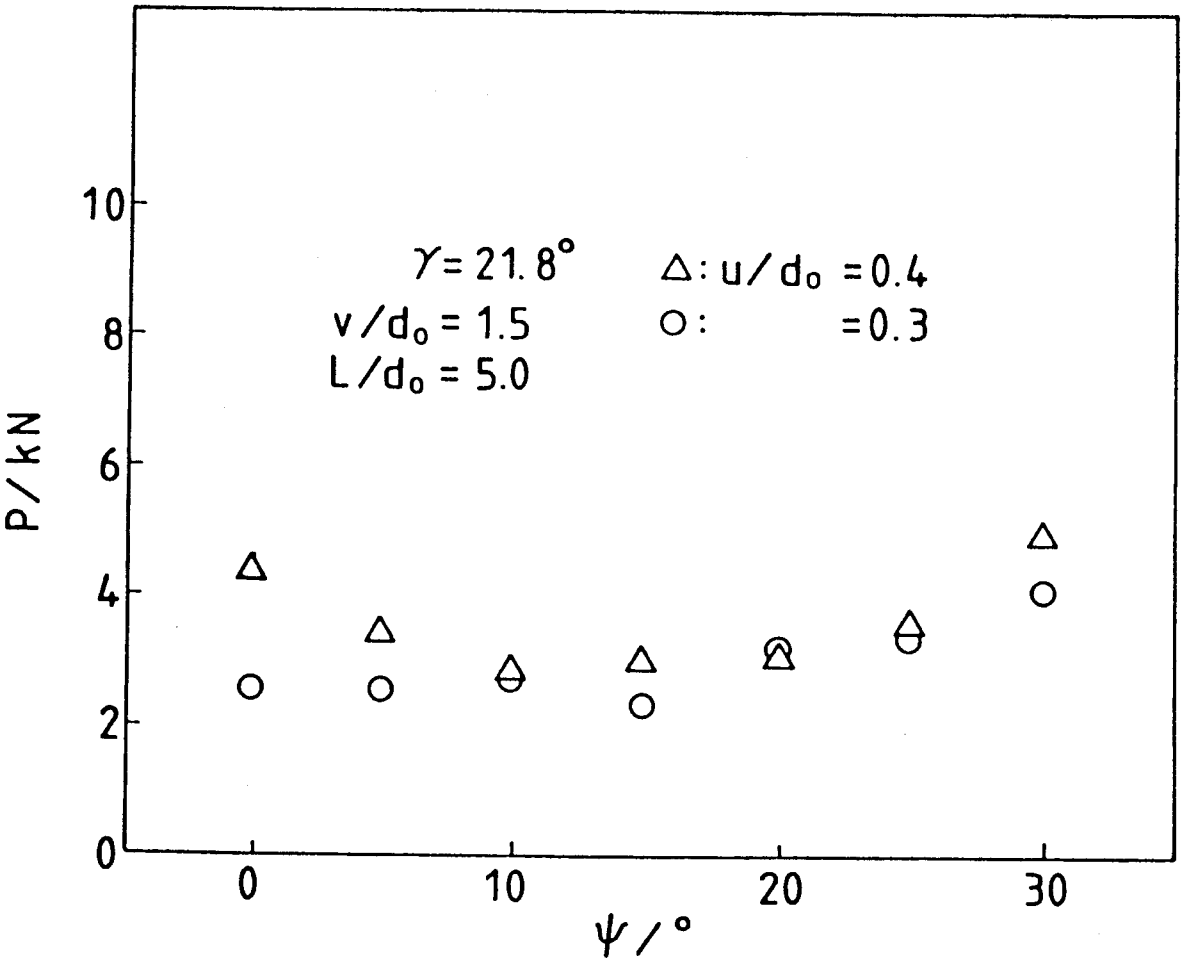
FIG. 10 is a graph illustrating the relationship between the inclination angle and the compressive force.

FIG. 7 and FIG. 8 visualize relationship between force P generated by the hydraulic cylinder 12 to allow the rod-like member 1 to penetrate for bending work and penetration length L of the rod-like member 1. The offset u was adopted as a parameter in FIG. 7, whereas the inclination angle $\psi$ of the die 3 was selected as a parameter in FIG. 8. P was large at the initial stage of the bending work where the rod-like member 1 was allowed to penetrate into the die 3 and bent, whereas P became smaller and constant at the stage after $L/d_0=3.0$ where the bending work should be smooth. FIG. 9 and FIG. 10 illustrate results of examinations made on the influence on the compressive force P due to the offset u and the inclination angle $\psi$ of the die 3 at $L/d_0=5.0$ where the bending work was performed smoothly. As is clear from FIG. 9, the compressive force P tended to be increased at any value of the approach v as the offset u became larger for bending the rod-like member 1 more severely. Further, P is increased as the approach v becomes smaller, and remarkably enhanced at $u/d_0>0.3$ and $v/d_0=1.0$ where the rod-like member 1 was bent especially severely. On the other hand, the compressive force P was the minimum within a range where the inclination angle $\psi$ of the die 3 was 10° to 20°. This fact indicates that the rod-like member 1 is subjected to the bending work most smoothly within this range of the inclination angle, and it will be understood that the die 3 should desirably be set at the inclination angles within this range.

Variation of Shape of Cross Section

Figure 11:
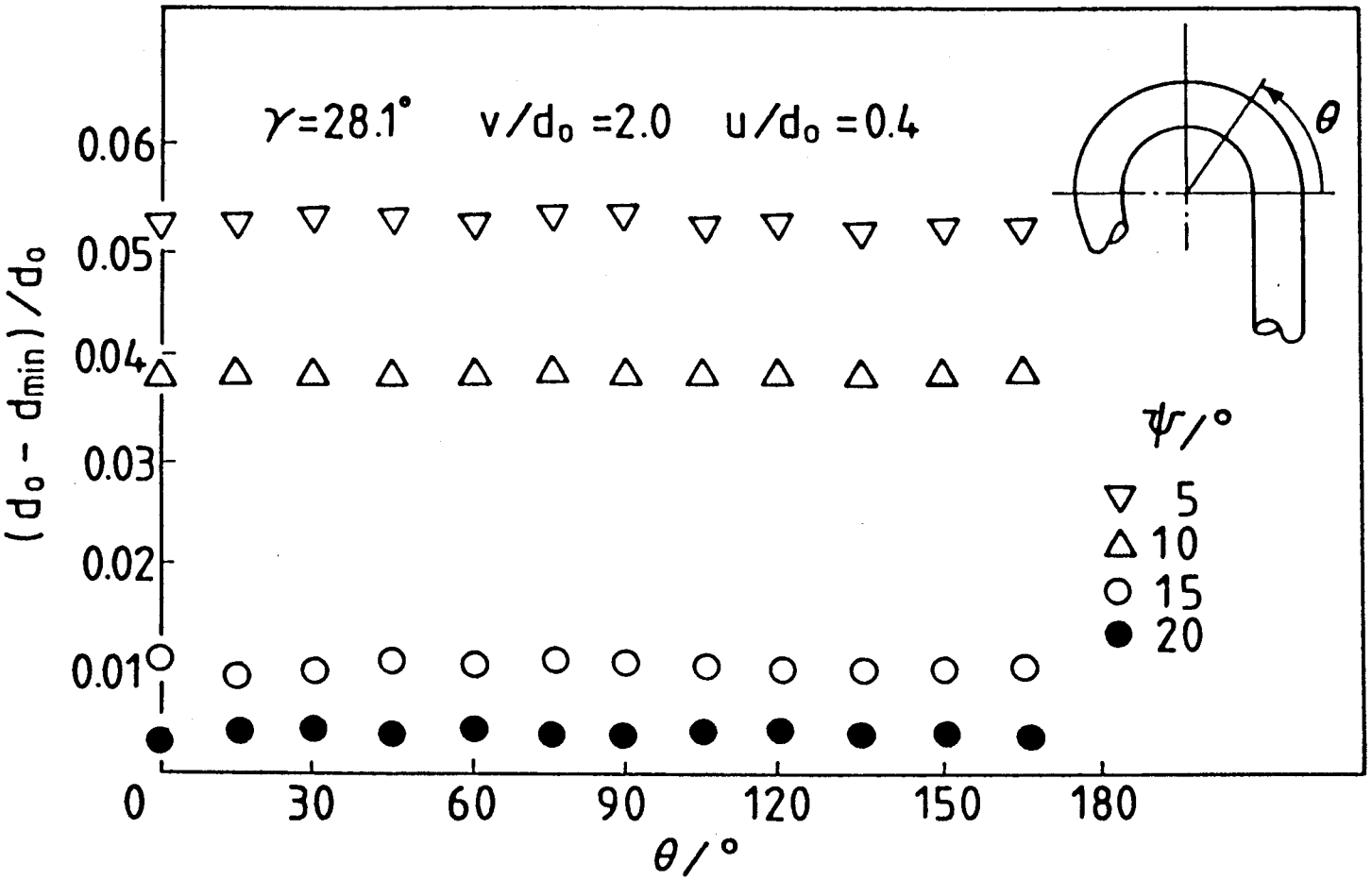
FIG. 11 is a graph illustrating flatness of cross section at various bent portions.

FIG. 11 visualizes relationship between bending angle $\theta$ and flatness of cross section $\alpha_f$. The inclination angle $\psi$ of the die 3 was used as a parameter and the bending angle R was set around 110 mm for checking variation of cross section. Since the rod-like member was bent within a limited range on and around the bearing portion 3*a*, and since no residual stress was applied to the rod-like member 1 after the bending work, the flatness of cross section $\alpha_f$ was constant at all the bent portions. When the inclination angle $\psi$ was set at 20°, for example, the rod-like member 1 showed nearly no variation in the cross section thereof and the flatness of cross section $\alpha_f$ was as low as 0.3%.

Figure 12:
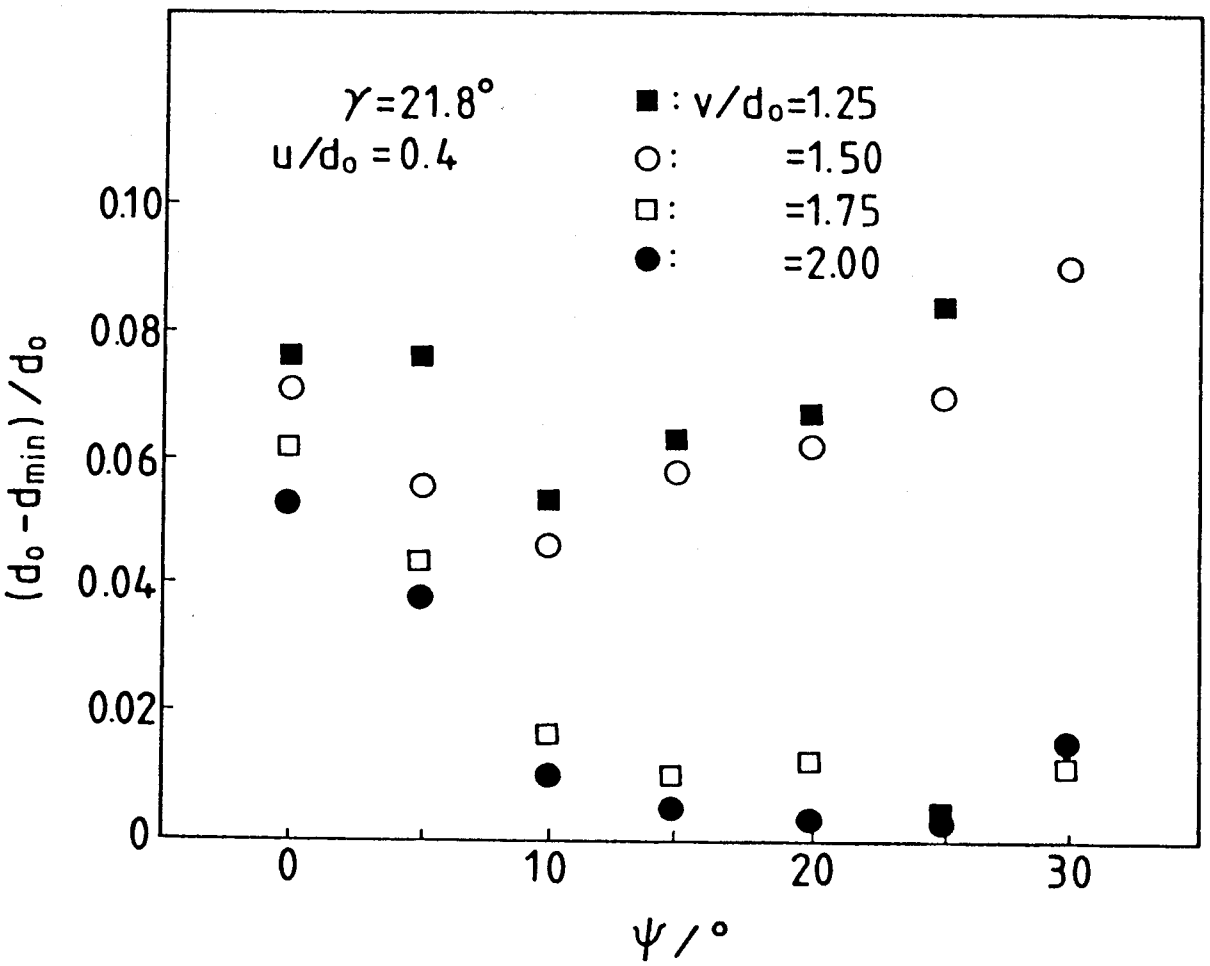
FIG. 12 is a graph visualizing the influence on the flatness of cross section due to the inclination angle of the die.

FIG. 12 illustrates the influence on the flatness of cross section $\alpha_f$ due to the inclination angle $\psi$ of the die 3. At $v/d_0=2.0$ or so where the rod-like member 1 was bent not so severely, the inclination angle $\psi$ of the die 3 exceeding 10° gave nearly no influence on the flatness of cross section $\alpha_f$ and variation of cross section was suppressed almost completely. On the other hand, when $v/d_0$ was 1.5 or smaller, the flatness of cross section $\alpha_f$ had a minimum value at around $\psi=15°$ and this inclination angle $\psi$ of the die 3 which minimized the compressive force P corresponds to the minimum value of the flatness of cross section $\alpha_f$ shown in FIG. 10. Judging from this fact, adequate selection of the inclination angle $\psi$ of the die 3 will make it possible to introduce the rod-like member, with smooth slide-contact and no forcible deformation, into the bearing portion 3*a* of the die 3, to minimize the compressive force P and also to minimize the flatness of cross section $\alpha_f$. If the inclination angle $\psi$ of the die 3 is not selected adequately relative to the penetration direction of the rod-like member 1, in contrast, the rod-like member will forcibly penetrate into the bearing portion 3*a* and be subjected to slide-contact other than that required for bending, thereby increasing the compressive force P and the flatness of cross section $\alpha_f$.

Figure 13:
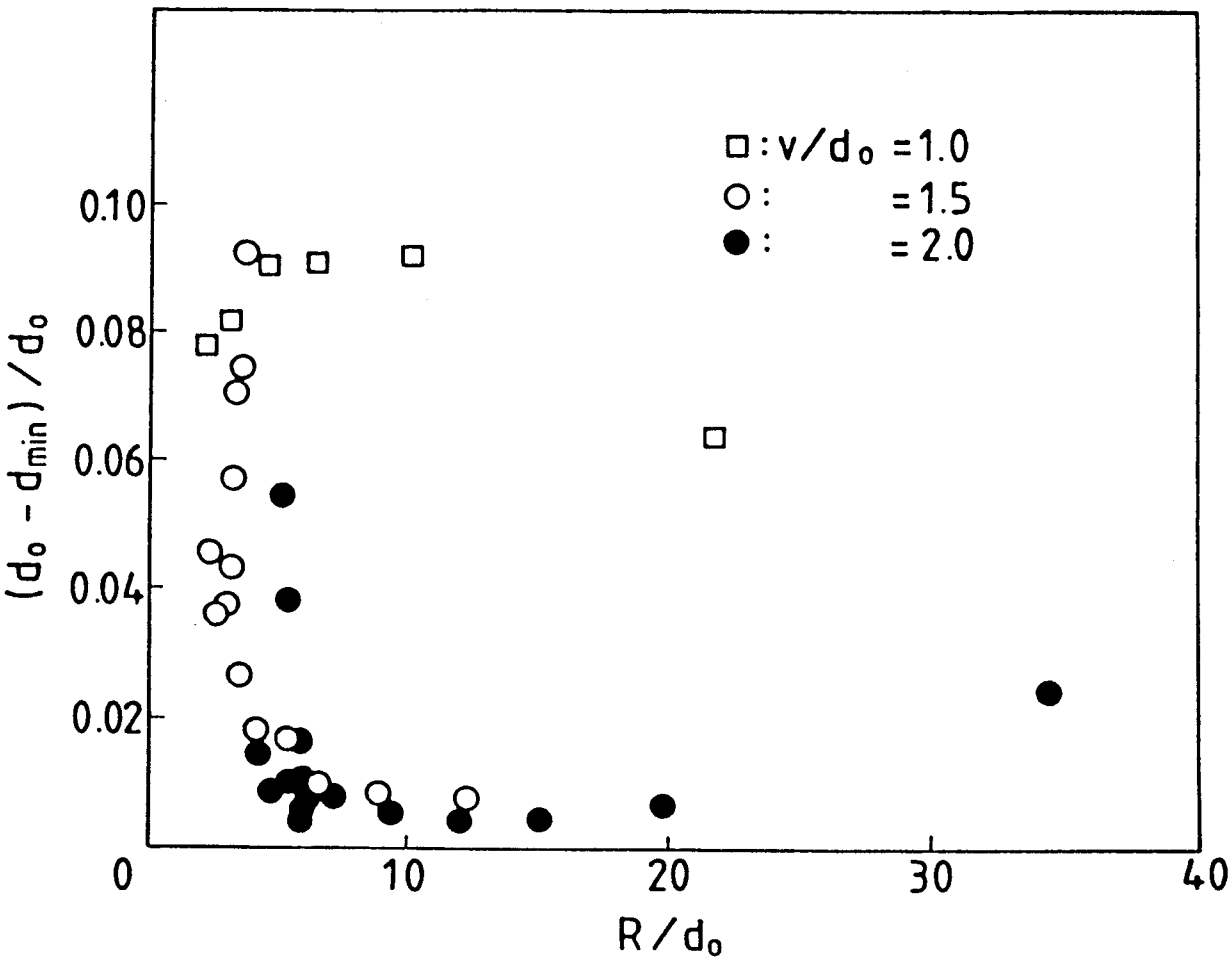
FIG. 13 is a graph illustrating the relationship between the bending radius and the flatness of cross section.

FIG. 13 summarizes values of the flatness of cross section $\alpha_f$ which were obtained at various lengths of the approach v and within a range of $R/d_0=1.8$ to 35. There was a tendency that the flatness of cross section $\alpha_f$ was enhanced even at the same bending radius R as $v/d_0$ was lowered. Further, the flatness of cross section $\alpha_f$ was enhanced as the bending radius R has smaller values. However, it was found that the bending machine was capable of performing bending works with of suppressed below 1% and with minimum variation of cross section within a range of $R/d_0=4.0$ to 20 which gave the best roundness in FIG. 6 so far as adequate bending conditions were selected.

Variation of Wall Thickness

Figure 14:
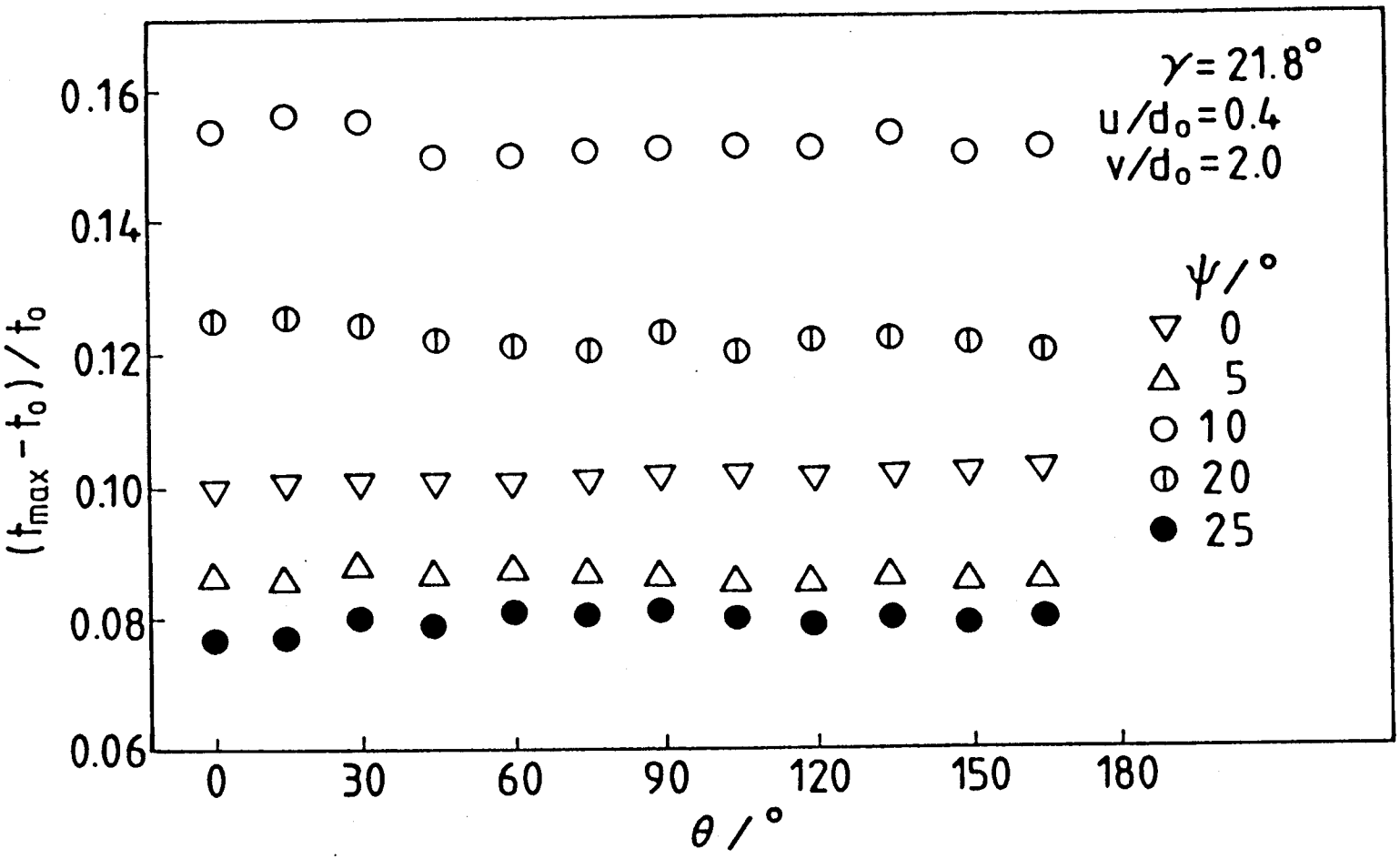
FIG. 14 is a graph visualizing variation of wall thickness inside various bent portions.

FIG. 14 shows relationship between the bending angle $\theta$ and variation of wall thickness $\alpha_{ti}$ inside bent portions of the rod-like member 1 which has been subjected to the bending work. The inclination angle $\psi$ of the die 3 was selected as a parameter and the bending angle R was set around 110 mm for obtaining the data presented in FIG. 14. For the same reason as that described on the flatness of cross section $\alpha_f$, variation of wall thickness was constant at all the bent portions.

Figure 15:
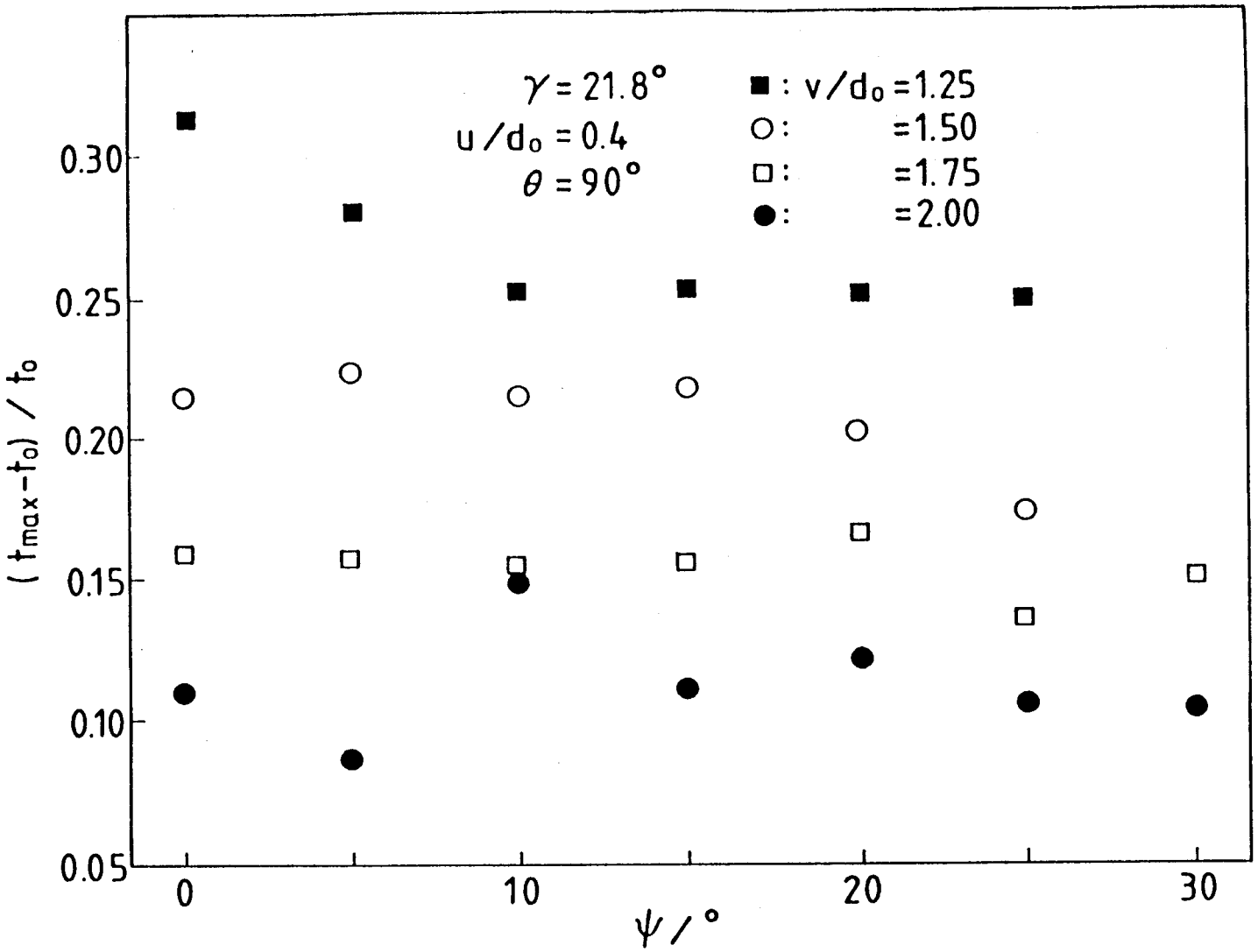
FIG. 15 is a graph illustrating the influence on variation of wall thickness inside various bent portions due to the inclination angle of the die.
Figure 16:
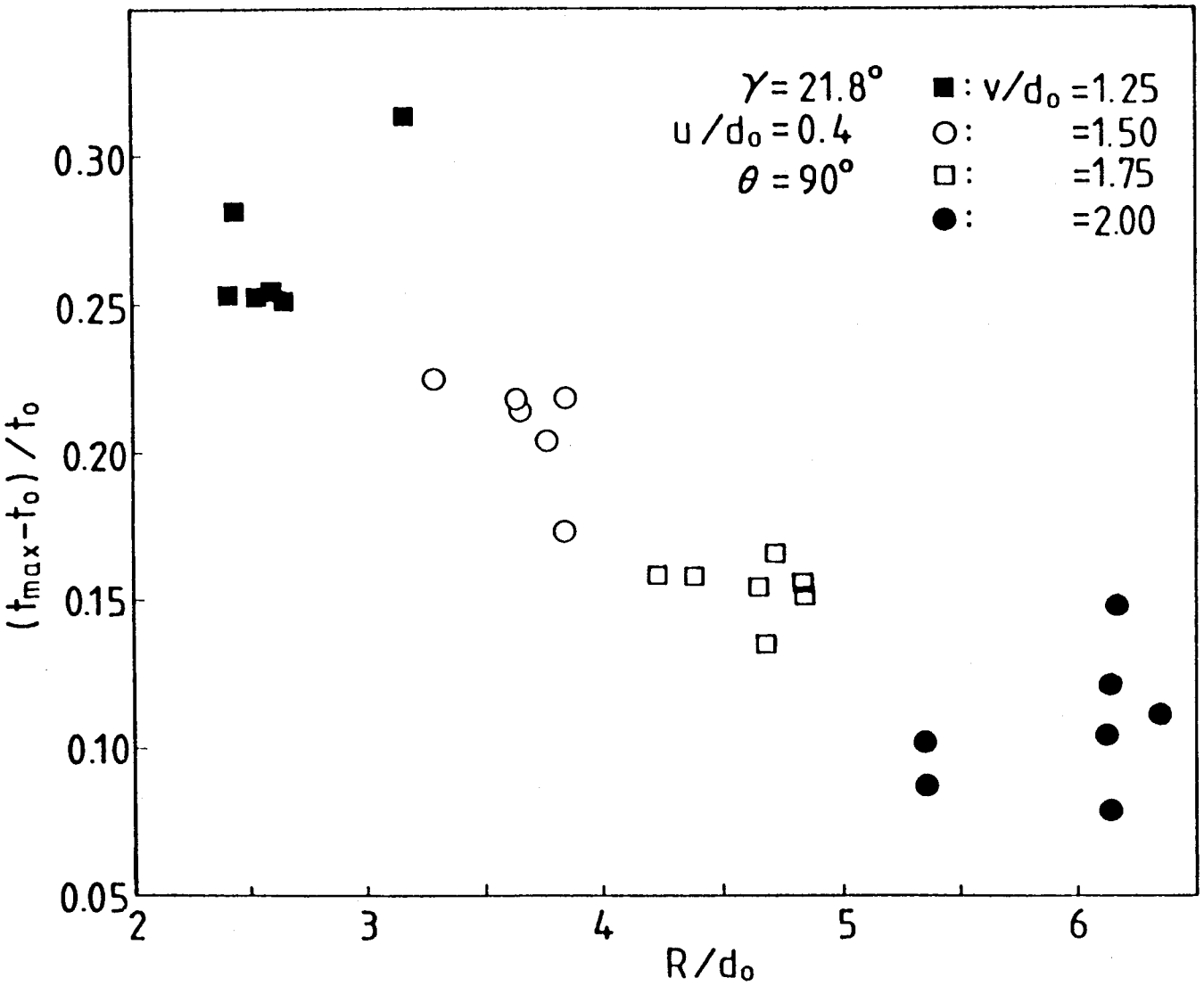
FIG. 16 is a graph visualizing the relationship between the bending radii and the variations of wall thickness inside bent portions.

Furthermore, FIG. 15 shows relationship between the inclination angle $\psi$ of the die 3 and variation of wall thickness $\alpha_{ti}$ inside bent portions, whereas FIG. 16 visualizes relationship between $R/d_0$ and the variation of wall thickness $\alpha_{ti}$ inside the bent portions. Though the variation of wall thickness $\alpha_{ti}$ showed a slight tendency to decrease as the inclination angle $\psi$ of the die 3 became larger, the variation of wall thickness $\alpha_{ti}$ was scarcely influenced by the inclination angle $\psi$ of the die 3. On the other hand, the variation of wall thickness $\alpha_{ti}$ was largely influenced by the bending angle R and increased as the bending angel R became larger.

Figure 17:
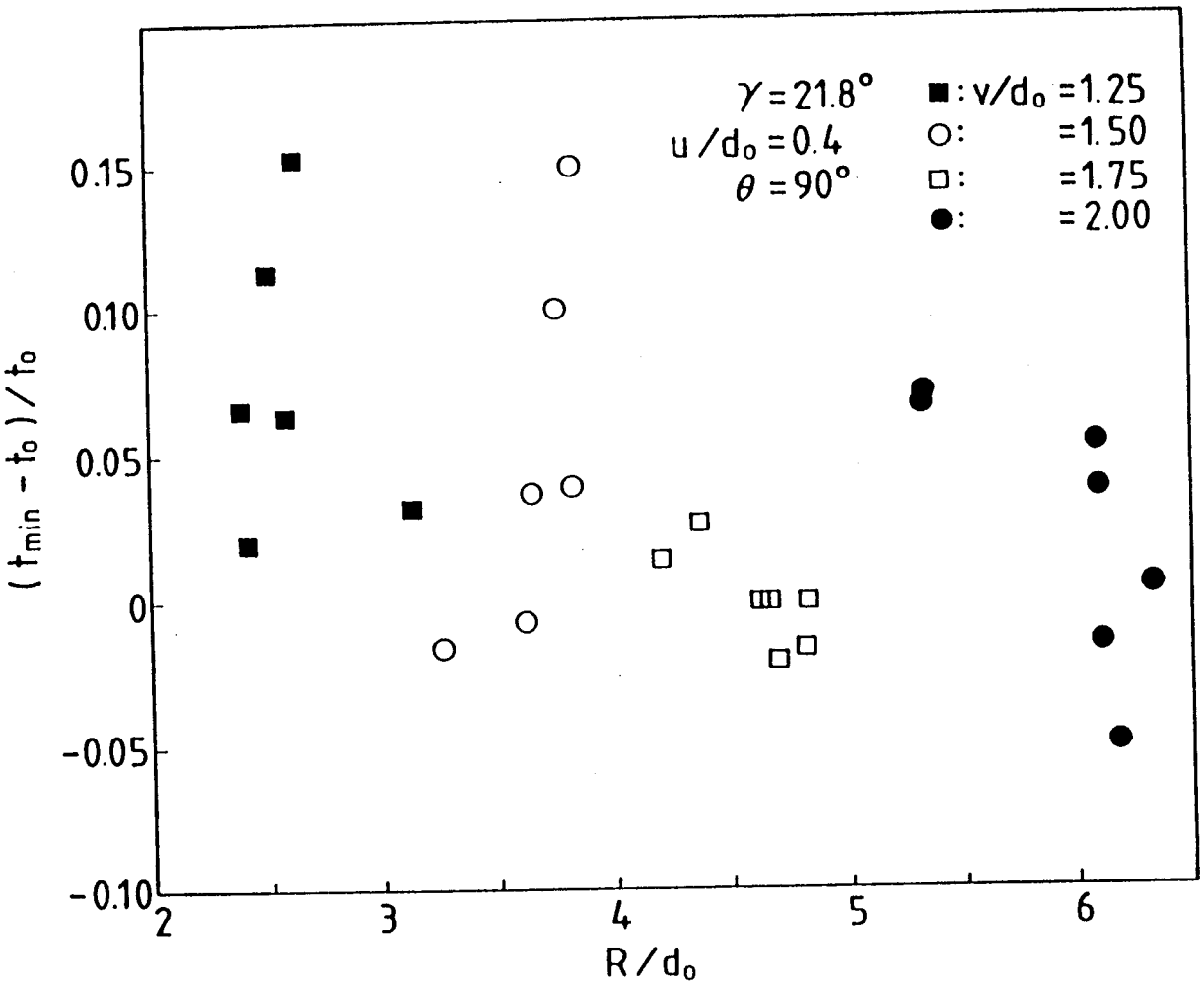
FIG. 17 is a graph illustrating the relationship between the bending radii and variations of wall thickness outside bent portions.

FIG. 17 illustrates relationship between $R/d_0$ and the variation of wall thickness $\alpha_{to}$ outside bent portions. Since the rod-like member 1 is bent while being subjected to the compressive force generated by the slide-contact, the variations of wall thickness $\alpha_{to}$ outside bent portions have positive values in most cases and have negative values in cases of 5% at most. In contrast to the conventional bending methods which always reduce wall thickness outside bent portions, the penetration bending method according to the present invention permits preventing reduction of wall thickness outside bent portions when the bending conditions are selected adequately. Further, there was notice a tendency that variation of wall thickness $\alpha_{to}$ outside bent portion was variable dependently on the inclination angle $\psi(=0^\circ$ to $30^\circ)$ of the die 3.

Now, the Embodiment 2 of the penetration bending machine according to the present invention will be described below.

Figure 18:
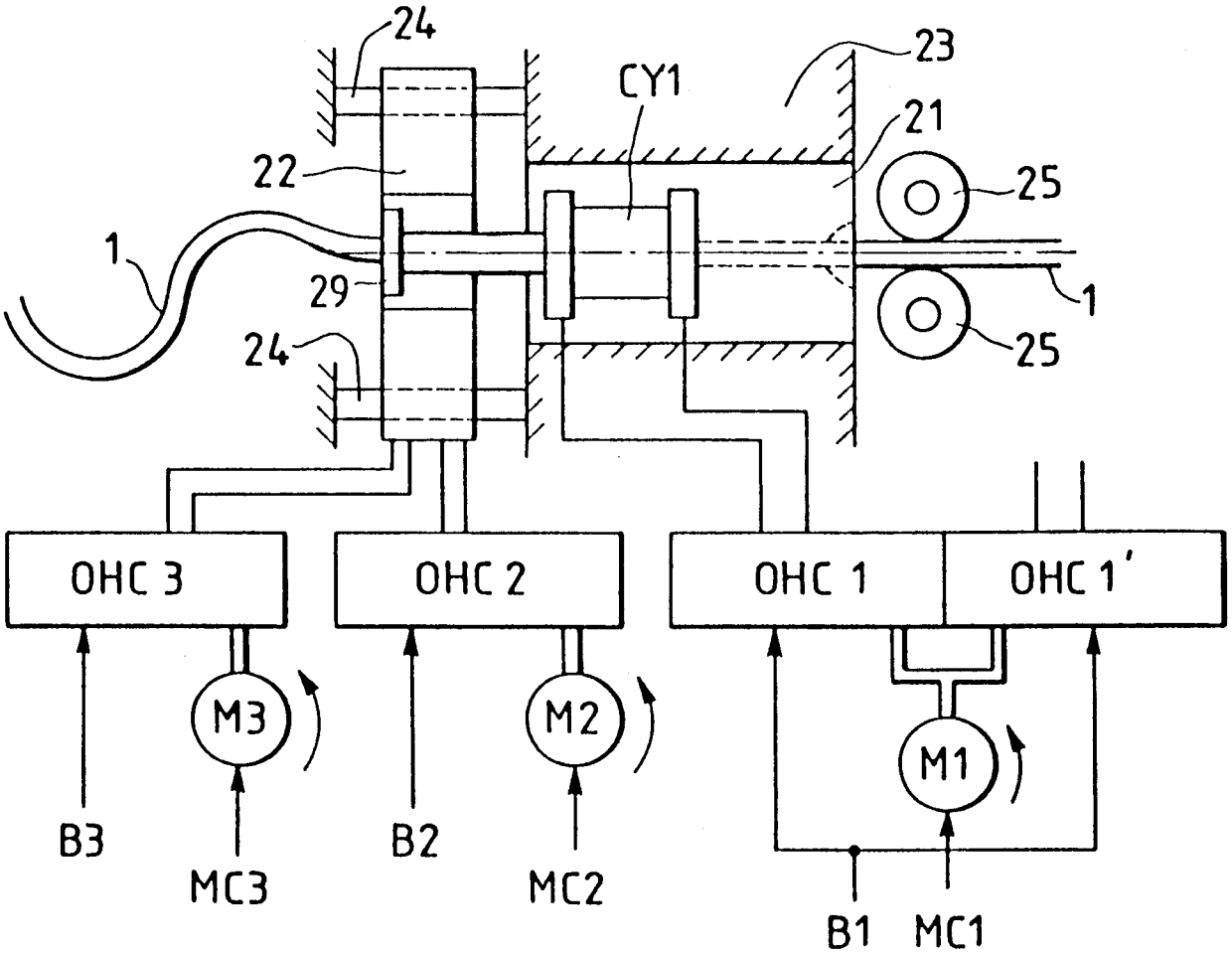
FIG. 18 is a schematic system diagram of the mechanical section and hydraulic circuit section of another embodiment of the penetration bending machine according to the present invention.
Figure 19:
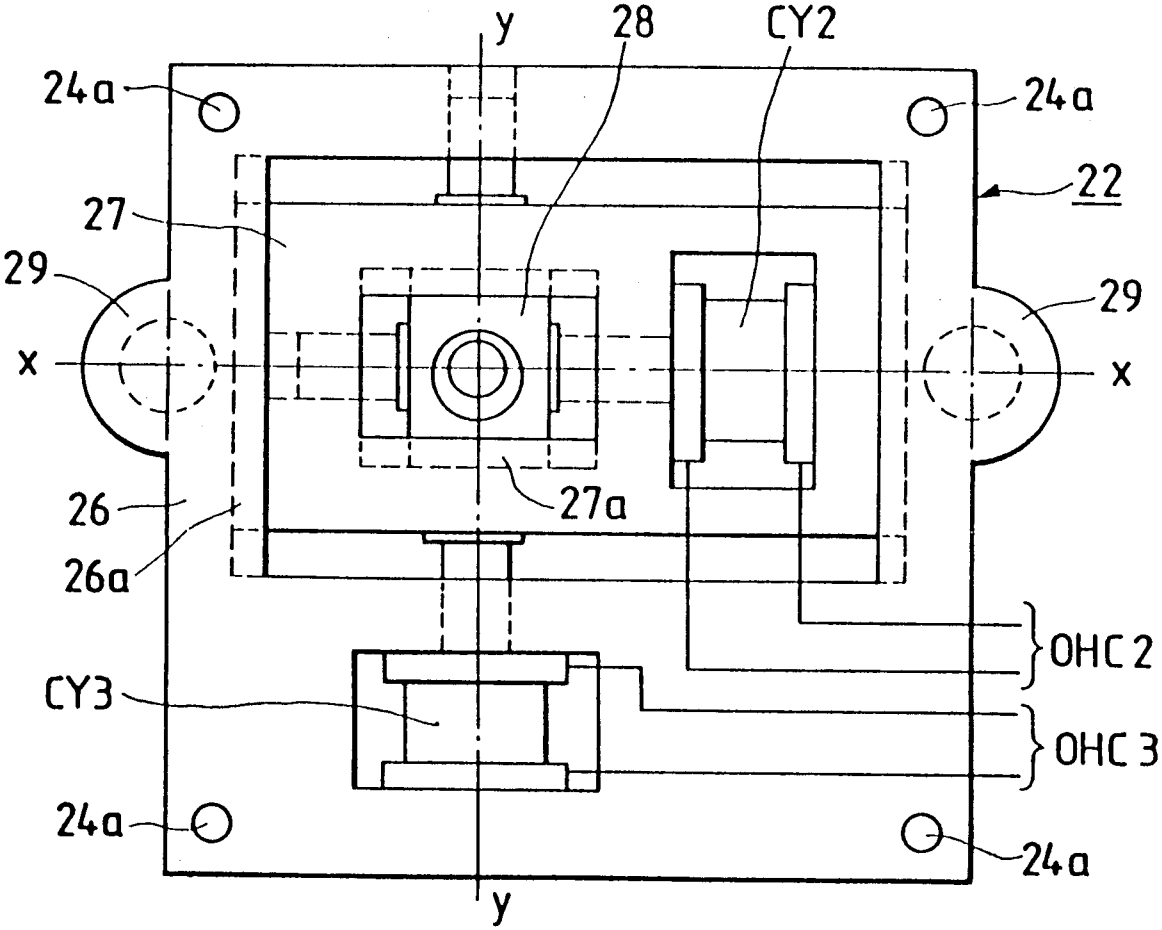
FIG. 19 is a front view of a die holder.
Figure 20:
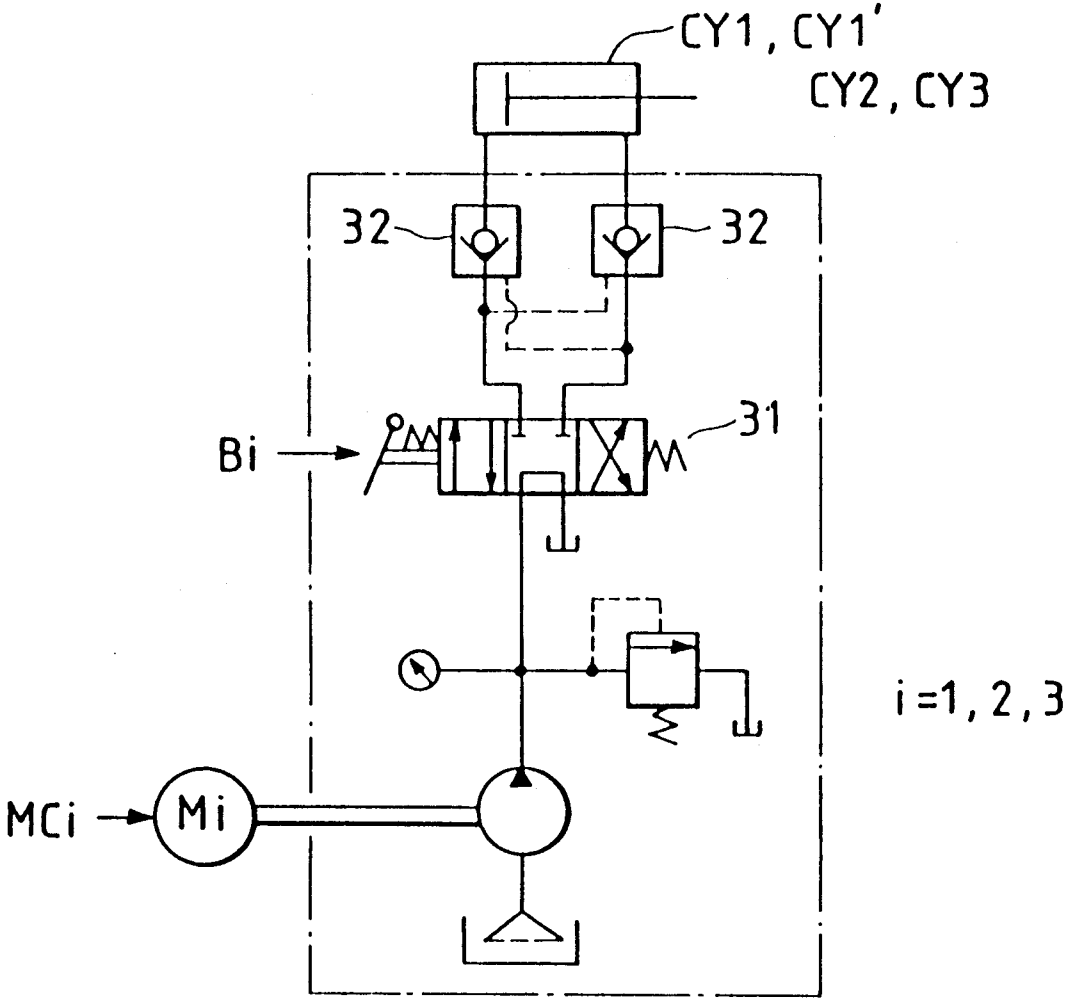
FIG. 20 is a circuit diagram of the hydraulic circuit.
Figure 21:
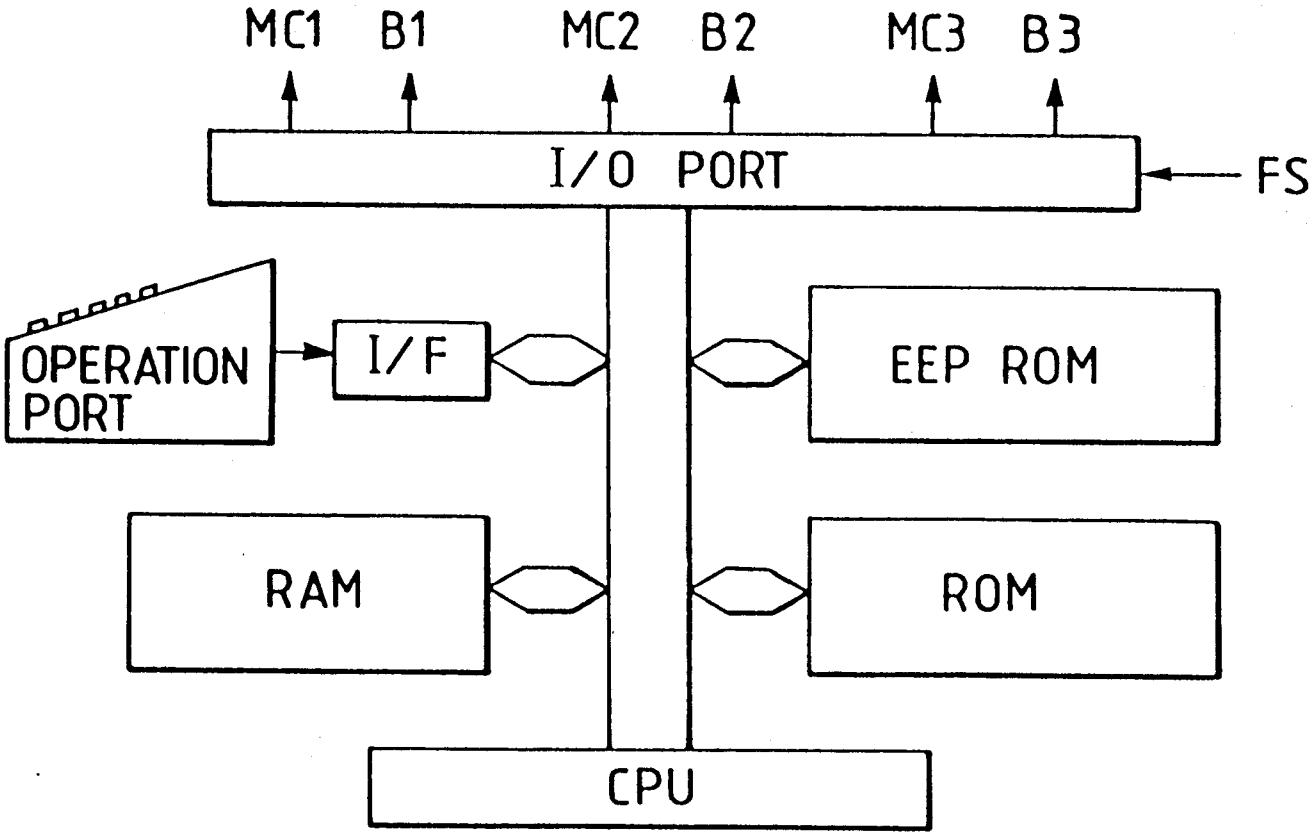
FIG. 21 is a circuit diagram of a microcomputer.

FIG. 18 shows a schematic system diagram of the mechanical section and the hydraulic circuit section of the Embodiment 2 of the penetration bending machine according to the present invention. In FIG. 18, the reference numeral 21 represents a guide cylinder, the reference numeral 22 designates a die holder, the reference numeral 23 denotes a stand for fixing the guide cylinder, the reference numeral 24 represents a guide for guiding the die holder 22, the reference numeral 25 designates rollers for feeding the rod-like member 1 into the bending machine, the reference symbols CY1 and CY1' (see FIG. 20) denote cylinders which are arranged on both the side of the guide cylinder 21 and serve for displacing the die holder 22 along the guide 24 (CY1' is not shown in FIG. 18), the reference symbols OCH1 and OCH1' represent hydraulic circuits for driving the cylinders CY1 and CY1', the reference symbols OCH2 and OCH3 designate hydrualic circuits for driving cylinders (CY2 and CY3 to be described later) which function to displace the die mounted on the die holder, and the reference symbols M1, M2 and M3 denote motors for driving the pumps of the hydraulic circuits OCH1 through OCH3. FIG. 19 shows a front view of the die holder 22 which consists of an outer frame 26 and inner frame 27. Inside the outer frame 26, a guide section 26*a* is formed to slide and guide the inner frame 27 only in the direction of the y axis while sustaining the inner frame in the outer frame, and the cylinder CY3 is built for displacing the inner frame 27. In the inner frame 27, on the other hand, a guide section 27*a* is formed for sliding and guiding die 28 only in the direction of x axis while holding the die in the inner frame, and the cylinder CY2 is built for displacing the die 28. In addition, formed at the four corners of the outer frame 24 are slots for allowing the guide 24 to pass therethrough and formed on both the sides of the outer frame 26 are rod mounts 29 for the cylinders CY1 and CY1' respectively. Accordingly, the die holder 22 is driven or moved back and forth by the cylinders CY1 and CY1', and the die 28 mounted on the die holder 22 can be displaced to optional positions within a certain definite range under driving by the cylinders CY2 and CY3. FIG. 20 shows a circuit diagram of each of the above-mentioned hydraulic circuits (OHC'S) wherein arranged between the cylinder CY and an electromagnetic changeover valve 31 is a pilot check valve 32 for locking, and the cylinder CY can be stopped and locked at optional positions by controlling a motor Mi and the electromagnetic changeover valve 31 with signals MCi and Bi respectively. The above-mentioned control signals MCi and Bi are outputted from a microcomputer circuit as shown in FIG. 21. This circuit consists of a ROM storing control programs for the bending machine, a RAM for storing updated data and input data, an EEPROM storing positional control data for the die 28 (actuating amount data: rotational frequency, etc. of each motor Mi) for performing bending work in the condition corresponding to the data on mechanical natures of the rod-like member 1 to be bent and bending conditions, an operation port, an operation port interface I/F and an I/O port which are connected through the buslines as shown in FIG. 21. The entire system is controlled by a CPU which reads out programs from the ROM for execution.

Figure 22:
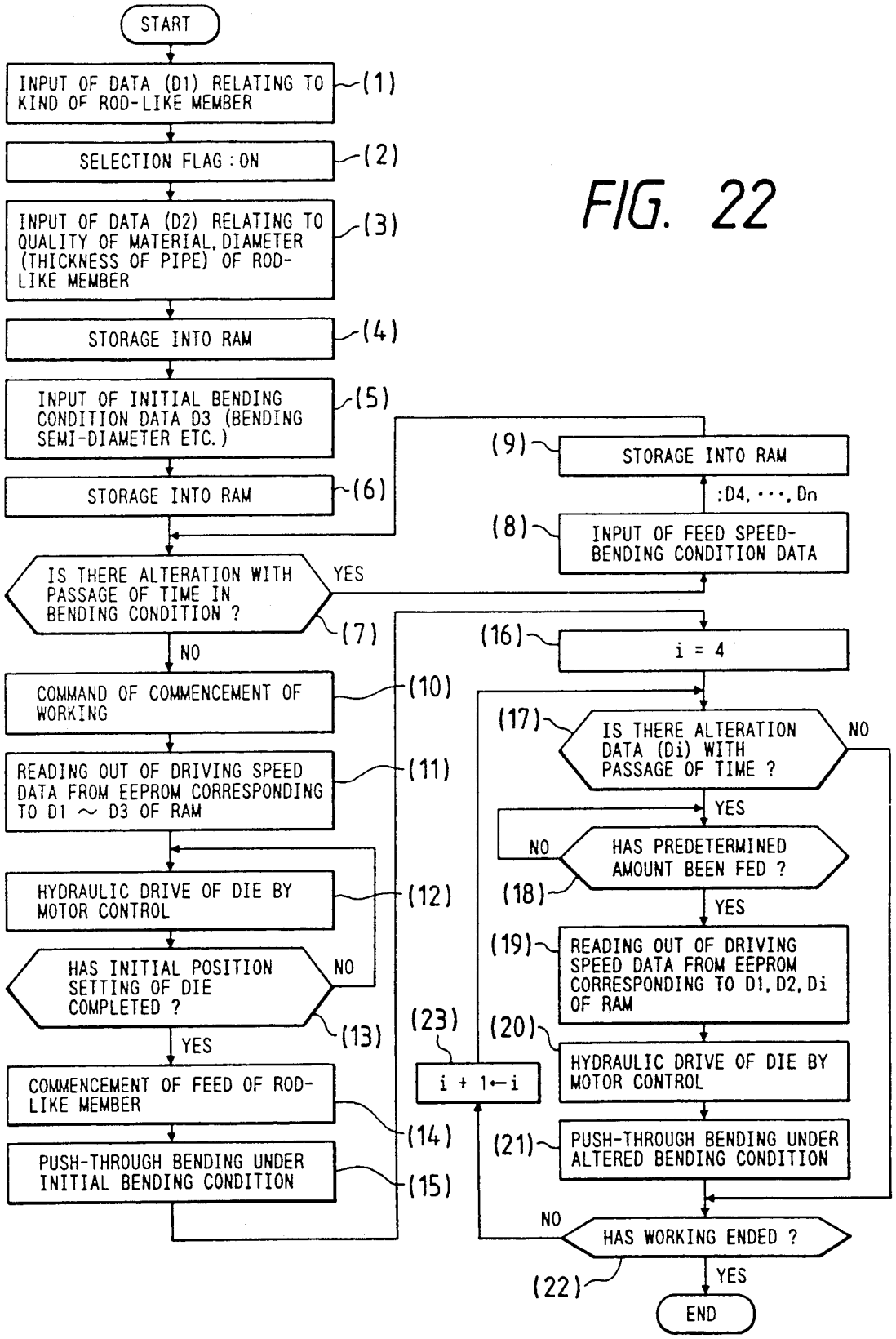
FIG. 22 is a flow chart illustrating operating steps of the penetration bending machine according to the present invention.

Now, operating steps of the bending machine will be described below with reference to the flow chart illustrated in FIG. 22.

First, a rod-like member to be bent is selected, and the die 28 having the bearing portion corresponding to the cross section of the rod-like member is selected and set in the inner frame 27 shown in FIG. 19. Then, data (D1) specifying type of the selected rod-like member, i.e., pipe, section or solid pipe, is inputted from the operation port to set ON the selection flag of the RAM corresponding to the selection (steps 1 and 2). Since the data on the material, outside diameter, thickness, etc. are known at this stage, these data (D2) are inputted from the operation port together with desired initial bending condition data (D3), i.e., data on initial bending radius, etc. These data are stored into the RAM at predetermined addresses (steps 3 to 6). When bending conditions are to be modified with lapse of time after start of the bending work, a feed speed before the modification and the data related to the bending conditions to be modified (Di) are inputted. These data are sequentially stored also into the RAM at predetermined addresses (steps 7, 8 and 9).

Upon commanding operation to the bending machine after completing operation described above, the CPU checks the data D1 through D3 in the RAM, reads out the actuating amount data corresponding to D1 through D3 from the EEPROM, and allows the I/O port to output the control signals MCi and Bi ($i=1, 2, 3$)(steps 10 and 11). The outputted data are inputted to each motor Mi and each hydraulic circuit OHCi for driving the motor Mi by the actuating amount corresponding to said data D1 through D3 and operating each cylinder CYi by way of each hydraulic circuit OHCi, thereby displacing the die holder 22 as a whole, the inner frame 27 thereof and the die 28 (step 12). When the die 28 is displaced for the distance and/or angle corresponding to said actuating amount data, the die 28 is set at an initial position thereof and the electromagnetic changeover valve 31 of each hydraulic circuit OHCi is closed to lock the die 28 (step 13). Upon completing this locking, feeding of the rod-like member to be bent is started by rotating the feed rollers 25 to allow the rod-like member to penetrate frame the guide cylinder into the die 28 (step 14). Accordingly, the rod-like member is bent by the die 28 which is set at the position corresponding to the data D1 through D3 (step 15). That is to say, the bending work is carried out in a condition where the offset u and the approach v are set at the optimum values corresponding to the data D1 through D3 on the mechanical natures of the rod-like member and the bending conditions.

On the other hand, the feed speed data FS for the rod-like member is always inputted into the I/P port during the bending work and the CPU always monitors this data. When the modification data Di for modifying the bending conditions with time is inputted at steps 8 and 9, the CUP compares the feed speed data FS with the data Di and, when both the data are coincident with each other, reads out the actuating amount data from the EEPROM which correspond to the bending conditions of the data D1, D2 and D3 stored in the RAM, thereafter setting the die 28 at the modified position by controlling the motor Mi and the electromagnetic changeover valve 31 as described above (steps 17 to 20). As a result, the die 28 is displaced to the optimum position corresponding to the bending conditions of the modification data Di each time the feed speed data of the modification data becomes coincident with the actual feed speed data FS, and the rod-like member is sequentially bent, during the penetration, into the form corresponding to the bending conditions of the data D3 and data D4 through Dn (steps 21, 22 and 23).

As is apparent from the above description, it will be possible to bend a rod-like member spirally if the device is constructed so that the rod-like member which goes out from the die member is pushed in the direction perpendicular to a plane including a bent circular arc of the rod-like member by a pushing plate which is operated by a drive means.

Furthermore, such motors as AC servo-motors may be used as the driving means instead of the hydraulic devices in the above mentioned embodiments.

What is claimed is:

1. A method for bending a rod-like member with apparatus for penetration bending of a rod-like member, the rod-like member having a first end, a second end, and a longitudinal axis disposed therebetween, said apparatus comprising:

a guide member for restrainably receiving the rod-like member, said guide member having a first end, a second end, and a longitudinal axis disposed therebetween, said guide member for permitting movement of the rod-like member within said guide member in a direction along the longitudinal axis of the rod-like member;

a die member disposed adjacent an end of said guide member;

means for moving at least one of said die member and said guide member relative to the other of said die member and said guide member along a plurality of paths within a plane perpendicular to the longitudinal axis of said guide member;

means for moving at least one of said die member and said guide member relative to the other of said die member and said guide member in a direction parallel to the longitudinal axis of said guide member to thereby alter the distance between said die member and said guide member;

said die member comprising a bearing for restrainably bearing a portion of the rod-like member to thereby bend the rod-like member as the rod-like member is passed through said guide member and said die member, said bearing portion having a given point; and means for moving said rod-like member longitudinally through said guide member and said die member;

said method comprising the steps of:

positioning at least one of said die member and said guide member a desired distance from the other of said die member and said guide member in a direction parallel to the longitudinal axis of the rod-like member;

moving at least one of said die member and said guide member in a multiplicity of angular directions along at least one of said plurality of paths within said plane perpendicular to the longitudinal axis of said guide member to relatively offset the longitudinal axis of said guide member a desired amount from the given point of said bearing portion of said die member;

advancing the rod-like member through said guide member with said means for moving said rod-like member in the direction along the longitudinal axis of the rod-like member;

further advancing the rod-like member with said means for moving said rod-like member past said die member so that a portion of the rod-like member contacts said bearing portion of said die member to thereby bend the rod-like member a desired amount in a plurality of directions;

said moving comprises moving said at least one of said die member and said guide member relative to the other of said die member and said guide member during said advancing of the rod-like member through said guide member and said die member to alter the offset amount between the longitudinal axis of said guide member and the given point of said bearing member to thereby alter at least one of: the amount of bending of the rod-like member, and the direction of bending of the rod-like member;

the offset amount between the longitudinal axis of said guide member and the given point of said bearing portion is continuously variable; and said moving at least one of said die member and said guide member comprises moving at least one of said die member and said guide member relative to the other of said die member and said guide member in at least one of said plurality of directions and continuously angularly variable over a given solid angle.

2. The method according to claim 1, wherein said bearing portion defines a longitudinal axis, said bearing portion being pivotable with respect to the longitudinal axis of said guide member so that the longitudinal axis of said bearing portion forms an angle of inclination with a line passing through the given point of said bearing portion and parallel to the longitudinal axis of said guide member.

3. The method according to claim 2, further including pivoting said bearing portion so that the longitudinal axis of said bearing portion forms an angle of inclination with a line passing through the given point of said bearing portion and parallel to the longitudinal axis of said guide member.

4. The method according to claim 3, wherein said bearing portion is pivotable within said die member, and said method further comprises pivoting said bearing portion within said die member to a desired inclination angle.

5. The method according to claim 4, wherein said angle of inclination is continuously variable.

6. The method according to claim 5, wherein said angle of inclination is continuously variable within a solid angle comprising a range of about 10° to about 20°.

7. The method according to claim 6, wherein said apparatus further includes:

a bearing portion which is for completely surrounding the rod-like member;

a drive control means for controlling said means for moving;

data input means for entering data for control of said drive control means, said data being storage in first member means for automatic control of said drive control means;

second memory means for additional storage of data for automatic control of said drive control means; and said method further comprising:

inputting data to control said drive control means to thereby relatively position said die member and said guide member with said means for moving;

inputting data into first memory means for providing automatic control of said drive control means to relatively position said die member and said guide member with said means for moving; and automatically controlling said said drive control means to relatively position said die member and said guide member with said means for moving by using data stored in said first and said second memory means.

8. Apparatus for penetration bending of a rod-like member, the rod-like member having, a first end, a second end, and a longitudinal axis disposed, therebetween, said penetration bending apparatus comprising:

a guide member for restrainably receiving the rod-like member, said guide member having a first end, a second end, and a longitudinal axis disposed therebetween, said guide member for permitting movement of the rod-like member within said guide member in a direction along the longitudinal axis of the rod-like member;

a die member disposed adjacent an end of said guide member;

said die member comprising a bearing portion for restrainably bearing a portion of the rod-like member to thereby bend the rod-like member a desired amount in a plurality of direction as the rod-like member is passed by said bearing portion;

said bearing portion comprising a given point;

said die member for being disposed adjacent said guide member to define a distance between said die member and said guide member along the longitudinal axis of said guide member;

means for longitudinally moving at least one of said die member and said guide member relative to the other of said die member and said guide member in a direction parallel to the longitudinal axis of said guide member to alter the distance between said guide member and said die member, the distance between said guide member and said die member being continuously variable;

means for moving at least one of said die member and said guide member relative to the other of said die member and said guide member in a multiplicity of angular directions along a plurality of paths within a plane perpendicular to the longitudinal axis of said guide member so that the longitudinal axis of said guide member is offset a desired amount from the given point of said die member, said means for moving further comprising means for moving at least one of said die member and said guide member relative to the other of said die member and said guide member during bending of the rod-like member to alter the offset amount between the longitudinal axis of said guide member and the given point of said bearing portion to thereby alter at least one of:

the amount of bending of the rod-like member, and the direction of bending of the rod-like member during said bending of the rod-like member;

the offset amount between the longitudinal axis of said guide member and the given point of said die member is continuously variable; and means for moving the rod-like member longitudinally through said guide member and said die member.

9. The apparatus according to claim 8, wherein said means for moving comprises means for moving at least one of said die member and said guide member relative to the other of said die member and said guide member in a plurality of directions and continuously angularly variable over a given solid angle.

10. The apparatus according to claim 9, wherein said bearing portion defines a longitudinal axis and said bearing portion is pivotable with respect to the longitudinal axis of said guide member so that the longitudinal axis of said bearing portion forms an angle of inclination with a line passing through the given point of said bearing portion and parallel to the longitudinal axis of said guide member.

11. The apparatus according to claim 10, wherein said bearing portion is pivotable within said die member.

12. The apparatus according to claim 11, wherein the inclination angle between the longitudinal axis of said bearing portion and the line passing through the given point of said bearing portion and parallel to the longitudinal axis of said guide member is continuously variable.

13. The apparatus according to claim 12, wherein the inclination angle between the longitudinal axis of said bearing portion and the line passing through the given point of said bearing portion and parallel to the longitudinal axis of said guide member is continuously variable within a solid angle comprising a range of about 10° to about 20°.

14. The apparatus according to claim 13, further including:

a bearing portion which is for completely surrounding the rod-like member;

driving means for providing relative movement between said die member and said guide member;

drive control means for controlling said driving means;

data input means for entering data for control of said drive control means, the data entered in said input means corresponding to data for at least one of:

mechanical characteristics of the rod-like member; and bending conditions for the rod-like material;

first memory means for storage of said entered data for providing automatic control of said drive control means; and second memory means for additional data storage for providing automatic control of said drive control means, the data in said second memory means corresponding to data for actuating relative positioning of said die member and said guide member.

* * * * *

UNITED STATES PATENT AND TRADEMARK OFFICE
CERTIFICATE OF CORRECTION

PATENT NO. : 5,111,675

DATED : May 12, 1992

INVENTOR(S) : Makoto MURATA

It is certified that error appears in the above-identified patent and that said Letters Patent is hereby corrected as shown below:

In column 6, line 55, after the second occurrence of 'the', delete "hydrauiic" and insert --hydraulic--.

In column 8, line 45, after 'with', delete "of" and insert --of--.

In column 13, line 11, Claim 7, after 'being', delete "storage" and insert --storable--.

In column 13, line 12, Claim 7, delete "member" and insert --memory--.

Signed and Sealed this

Nineteenth Day of October, 1993

Bruce Lehman

*Attest:*

*Attesting Officer*

BRUCE LEHMAN

*Commissioner of Patents and Trademarks*